US010464344B2

(12) United States Patent
Sugawara et al.

(10) Patent No.: US 10,464,344 B2
(45) Date of Patent: Nov. 5, 2019

(54) LIQUID EJECTING HEAD AND METHOD FOR MANUFACTURING LIQUID EJECTING HEAD UNIT

(71) Applicant: SEIKO EPSON CORPORATION, Tokyo (JP)

(72) Inventors: Yoshiki Sugawara, Shiojiri (JP); Hiroyuki Hagiwara, Matsumoto (JP); Katsuhiro Okubo, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/830,414

(22) Filed: Dec. 4, 2017

(65) Prior Publication Data

US 2018/0170048 A1 Jun. 21, 2018

(30) Foreign Application Priority Data

Dec. 15, 2016 (JP) ..... 2016-243740

(51) Int. Cl.

| | |
|---|---|
| ***B41J 2/235*** | (2006.01) |
| ***B41J 2/155*** | (2006.01) |
| ***B41J 2/175*** | (2006.01) |
| ***B41J 2/245*** | (2006.01) |
| ***B41J 25/304*** | (2006.01) |
| *B41J 2/165* | (2006.01) |

(52) U.S. Cl.

CPC ..... *B41J 2/235* (2013.01); *B41J 2/155* (2013.01); *B41J 2/245* (2013.01); *B41J 25/304* (2013.01); *B41J 2/1752* (2013.01); *B41J 2002/16591* (2013.01); *B41J 2202/14* (2013.01); *B41J 2202/20* (2013.01); *B41J 2202/21* (2013.01)

(58) Field of Classification Search

CPC ... B41J 2/235; B41J 2/245; B41J 2/155; B41J 2002/16591; B41J 2202/21; B41J 2202/14; B41J 2202/20; B41J 25/304

See application file for complete search history.

(56) References Cited

U.S. PATENT DOCUMENTS

| | | | | |
|---|---|---|---|---|
| 9,227,444 | B1 | 1/2016 | Ben-Noon | |
| 9,802,414 | B2 * | 10/2017 | Lee | B41J 2/17 |
| 2012/0038709 | A1 | 2/2012 | Owaki | |

FOREIGN PATENT DOCUMENTS

| | | | |
|---|---|---|---|
| EP | 2913188 | A2 | 9/2015 |
| JP | 2004-090496 | | 3/2004 |
| JP | 2005138527 | A | 6/2005 |
| JP | 2005-178201 | | 7/2005 |
| WO | 2016039515 | A1 | 3/2016 |

OTHER PUBLICATIONS

European Search Report issued in Application No. 17206744 dated May 2, 2018.

* cited by examiner

*Primary Examiner* — Geoffrey S Mruk
(74) *Attorney, Agent, or Firm* — Workman Nydegger

(57) ABSTRACT

A liquid ejecting head includes a pressure generating unit in order to eject liquid from a nozzle that is provided on a nozzle surface, a case in order to accommodate the pressure generating unit, and a guide portion that is provided on a side surface of the case, in which in a case of being viewed from a first direction orthogonal to the nozzle surface, the guide portion has projecting portions facing one end side in a second direction along the nozzle surface, and recessed portions facing the other end side in the second direction.

15 Claims, 16 Drawing Sheets

LIQUID EJECTING HEAD AND METHOD FOR MANUFACTURING LIQUID EJECTING HEAD UNIT

CROSS-REFERENCE TO RELATED APPLICATIONS

The entire disclosure of Japanese Patent Application No. 2016-243740, filed Dec. 15, 2016 is incorporated by reference herein.

BACKGROUND

1. Technical Field

The present invention relates to a liquid ejecting head for ejecting a liquid from a nozzle, and a method for manufacturing a liquid ejecting head unit including the liquid ejecting head.

2. Related Art

A liquid ejecting apparatus represented by an ink jet recording apparatus such as an ink jet printer or a plotter includes a liquid ejecting head capable of ejecting liquid such as ink stored in a cartridge or a tank as droplets.

In the liquid ejecting head used in such a liquid ejecting apparatus, it is difficult to increase a length (multiple nozzles) or a density of nozzle openings as a single unit because the liquid ejecting head is increased in size, a yield is lowered, and a manufacturing cost is expensive. Therefore, a liquid ejecting head unit in which a plurality of liquid ejecting heads are fixed to a common fixing member to form a unit is proposed (for example, refer to JP-A-2005-178201).

However, when liquid ejecting heads are disposed apart from each other, a size of a liquid ejecting head unit is increased. Therefore, although the size can be reduced by providing each liquid ejecting heads as close as possible to each other, in a case where each liquid ejecting heads are provided as close as possible to each other, there is a problem that it is difficult to fix the liquid ejecting heads because the space is narrow.

SUMMARY

An advantage of some aspects of the invention is to provide a liquid ejecting head which can dispose liquid ejecting heads close to each other and can easily position the liquid ejecting heads, and a method for manufacturing a liquid ejecting head unit.

According to an aspect of the invention, a liquid ejecting head includes a pressure generating unit that ejects liquid from a nozzle which is provided on a nozzle surface, a case that accommodates the pressure generating unit, and a guide portion that is provided on a side surface of the case, in which in a case of being viewed from a first direction orthogonal to the nozzle surface, the guide portion has a projecting portion facing one end side in a second direction along the nozzle surface, and a recessed portion facing the other end side in the second direction.

In the aspect, when a plurality of liquid ejecting heads are arranged in parallel in the second direction, the other liquid ejecting head engages the projecting portion and the recessed portion in the second direction with respect to the one liquid ejecting head. Therefore, movements of not only the second direction but also the second direction and the direction orthogonal to the first direction are restricted so that the two liquid ejecting heads can be easily positioned. In addition, the guide portions of the liquid ejecting heads adjacent to each other in the second direction abut on each other, so that the liquid ejecting heads adjacent to each other in the second direction can be disposed close to each other.

Here, it is preferable that the case include a first case and a second case stacked in the first direction orthogonal to the nozzle surface, and any one of the projecting portion and the recessed portion be provided on one end side of the first case, and the other be provided on the other end side of the second case. Accordingly, when the plurality of liquid ejecting heads are arranged in parallel in the second direction, since one of the projecting portion and the recessed portion of the first case provided on one end side in one first direction and the other of the projecting portion and the recessed portion of the second case provided on the other end side in the other first direction can be engaged, one of the liquid ejecting heads can be moved in the first direction in a state where one liquid ejecting head is positioned on the other end side in the second direction of the other liquid ejecting head.

In addition, it is preferable that in a case of being viewed from the first direction, the case have a shape in which a first portion through which a center line parallel to a long side of a rectangle having the smallest area and including the case passes, and a second portion which does not pass through the center line are arranged in the direction of the long side, and have a shape in which a third portion which does not pass through the center line is arranged on the side opposite to the second portion with the first portion interposed therebetween. Accordingly, when positioning the liquid ejecting heads adjacent to each other in the second direction, it is possible to position the side surfaces of the second portion and the third portion of the liquid ejecting head adjacent to each other by abutting on each other. In addition, if the direction of the long side is the second direction, when the plurality of liquid ejecting heads are arranged in parallel in the second direction, it is possible to reduce the size in the direction orthogonal to the first direction and the second direction.

In addition, it is preferable that screws be accommodated in the second portion and the third portion of the case. Accordingly, by accommodating the screw in the case, the liquid ejecting head can be fixed to the support body or the like by the screw from the case side, and the liquid ejecting head can be easily fixed as compared with the case of screwing from the nozzle surface side. In addition, a new space for providing screws is unnecessary, so that the size of the liquid ejecting head can be reduced, and the plurality of liquid ejecting heads can be disposed close to each other.

In addition, it is preferable that the projecting portion facing one end side in the second direction be provided in one of the second portion and the third portion, and a projecting portion facing the other end side in the second direction be provided on the other of the second portion and the third portion, and the screws be provided on both of the projecting portion facing the one end side in the second direction and the projecting portion facing the other end side in the second direction.

Accordingly, since the projecting portions are provided on both sides in the second direction, it is possible to guide the positioning by abutting two projecting portions and two recessed portions on each other in the liquid ejecting heads adjacent to each other in the second direction, and it is possible to further prevent a positional shift of the liquid ejecting heads adjacent to each other in the second direction.

In addition, if the liquid ejecting head is point symmetric, the liquid ejecting head can be arranged rotated by 180 degrees.

Furthermore, according to another aspect of the invention, a liquid ejecting head includes a pressure generating unit that ejects liquid from a nozzle which is provided on a nozzle surface, and a case that accommodates the pressure generating unit and a screw, in which in a case of being viewed from a first direction orthogonal to the nozzle surface, the case has a shape in which a first portion through which a center line parallel to a long side of a rectangle having the smallest area and including the case passes, and a second portion which does not pass through the center line are arranged in the direction of the long side, and has a shape in which a third portion which does not pass through the center line is arranged on the side opposite to the second portion with the first portion interposed therebetween, guide portions are provided on both sides in the direction of the long side, and the screws are provided in the second portion and the third portion.

In the aspect, when the plurality of liquid ejecting heads are arranged in parallel in the second direction, the size in the first direction and the direction orthogonal to the second direction can be reduced. In addition, when positioning the liquid ejecting heads adjacent to each other in the second direction, it is possible to position the side surfaces of the second portion and the third portion of the liquid ejecting head adjacent to each other by abutting on each other as the guide portion.

In addition, by accommodating the screw in the case, the liquid ejecting head can be fixed to the support body or the like by the screw from the case side, and the liquid ejecting head can be easily fixed as compared with the case of screwing from the nozzle surface side. In addition, a new space for providing screws is unnecessary, so that the size of the liquid ejecting head can be reduced, and the plurality of liquid ejecting heads can be disposed close to each other.

In addition, it is preferable that in a case of being viewed from the first direction, the guide portion have a projecting portion facing one end side in the direction of the long side along the nozzle surface, and a recessed portion facing the other end side in the direction of the long side. Accordingly, when a plurality of liquid ejecting heads are arranged in parallel in the second direction, the other liquid ejecting head engages the projecting portion and the recessed portion in the second direction with respect to the one liquid ejecting head. Therefore, movements of not only the second direction but also the second direction and the direction orthogonal to the first direction are restricted so that the two liquid ejecting heads can be easily positioned. In addition, the guide portions of the liquid ejecting heads adjacent to each other in the second direction abut on each other, so that the liquid ejecting heads adjacent to each other in the second direction can be disposed close to each other.

In addition, it is preferable that the case have a tapered portion of which a width gradually reduces the width in the second direction from the nozzle surface side in the first direction toward the opposite side, and any one of the projecting portion and the recessed portion of the guide portion be provided in the tapered portion. Accordingly, when the plurality of liquid ejecting heads are arranged in parallel, since the space on the side opposite to the nozzle surface of one liquid ejecting head increases, the other liquid ejecting head can be likely to be inserted from the first direction.

In addition, it is preferable that the recessed portion have two opposing sides, and one side of the two sides be longer than the other side. Accordingly, the engaging area between the projecting portion and the recessed portion is increased, and the positional shift is unlikely to occur.

In addition, it is preferable that the recessed portion be provided such that a width thereof gradually decreases from the opening toward the bottom surface in the second direction when viewed from the first direction, and the projecting portion be provided such that a width thereof gradually decreases toward the tip end in the second direction when viewed from the first direction. Accordingly, the plurality of liquid ejecting heads are relatively moved in the second direction, so that the recessed portion and the projecting portion can be easily engaged with each other.

In addition, it is preferable that a stopper be provided on the outer periphery of the screw so as to restrict the screw so as not to come out of the case. Accordingly, by gripping the screw, handling of the liquid ejecting head and positioning of the liquid ejecting head can be easily performed without gripping the case. In addition, since the handling and positioning of the liquid ejecting heads can be performed by gripping the screw, the liquid ejecting heads can be arranged close to each other without leaving a space for gripping the plurality of liquid ejecting heads.

In addition, it is preferable that in a state where the tip end of the screw is fixed, the screw do not exceed the height of the case. Accordingly, it is possible to prevent the screw from being an obstacle when connecting the external wiring and the flow path to the case.

In addition, it is preferable that the dimension of the case in the first direction be larger than the width in the direction of the short side of a rectangle having the smallest area and including the case, when the case is viewed from the first direction. Accordingly, since the liquid ejecting head has a small installation area and a high height in the first direction, it is possible to easily position and arrange the plurality of liquid ejecting heads in the second direction by providing the guide portion.

Furthermore, according to still another aspect of the invention, a method for manufacturing a liquid ejecting head unit that includes a liquid ejecting head having a pressure generating unit in order to eject liquid from a nozzle that is provided on a nozzle surface, a case in order to accommodate the pressure generating unit, and a guide portion that is provided on a side surface of the case, in which in a case of being viewed from a first direction orthogonal to the nozzle surface, the guide portion has a projecting portion facing one end side in a second direction along the nozzle surface, and a recessed portion facing the other end side in the second direction, and a support body common to a plurality of the liquid ejecting heads and holding the plurality of the liquid ejecting heads arranged in parallel in the second direction, the method includes fixing the liquid ejecting head to the support body from the first direction, and moving the liquid ejecting head which is not fixed in the first direction to fix the liquid ejecting head to the support body, while the guide portion of the liquid ejecting head which is not fixed abuts on the guide portion of the liquid ejecting head which is fixed to the support body in the second direction.

In the aspect, when a plurality of liquid ejecting heads are arranged in parallel in the second direction, the other liquid ejecting head engages the projecting portion and the recessed portion in the second direction with respect to the one liquid ejecting head. Therefore, movements of not only the second direction but also the second direction and the direction orthogonal to the first direction are restricted so that the two liquid ejecting heads can be easily positioned. In addition, the guide portions of the liquid ejecting heads adjacent to each other in the second direction abut on each other, so that the liquid ejecting heads adjacent to each other in the second direction can be disposed close to each other.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
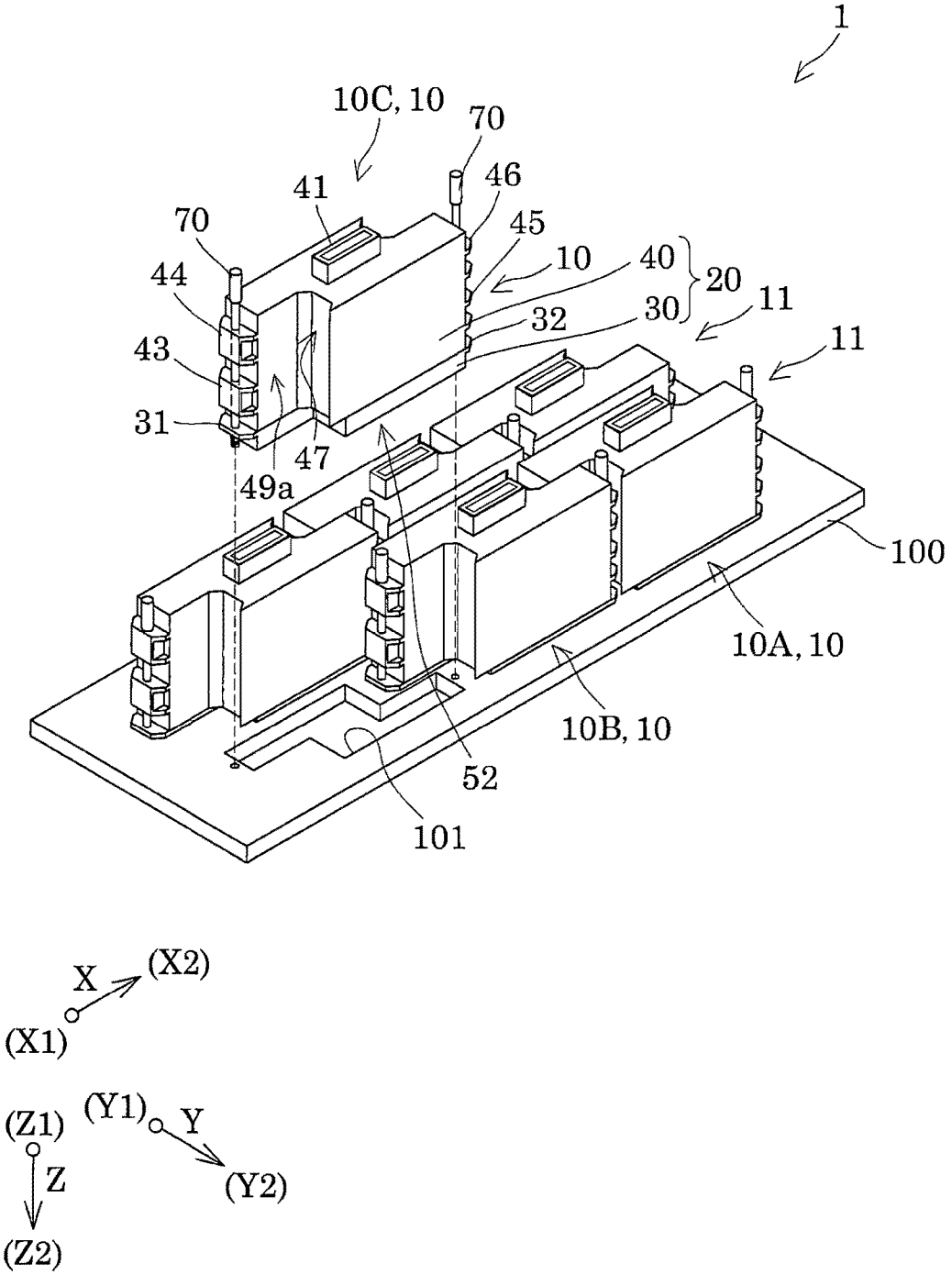
FIG. 1 is a perspective view of a head unit according to Embodiment 1 of the invention.

Hereinafter, embodiments of the invention will be described with reference to the drawings. However, the following description illustrates one embodiment of the invention, and can be arbitrarily changed within the scope of the invention. In the drawings, the same reference numerals are given to the same members, and descriptions thereof are not repeated as appropriate. In addition, in the drawings, X, Y, and Z represent three spatial axes orthogonal to each other. In the specification, directions along these axes will be described as X direction, Y direction, and Z direction.

Embodiment 1

Figure 2:
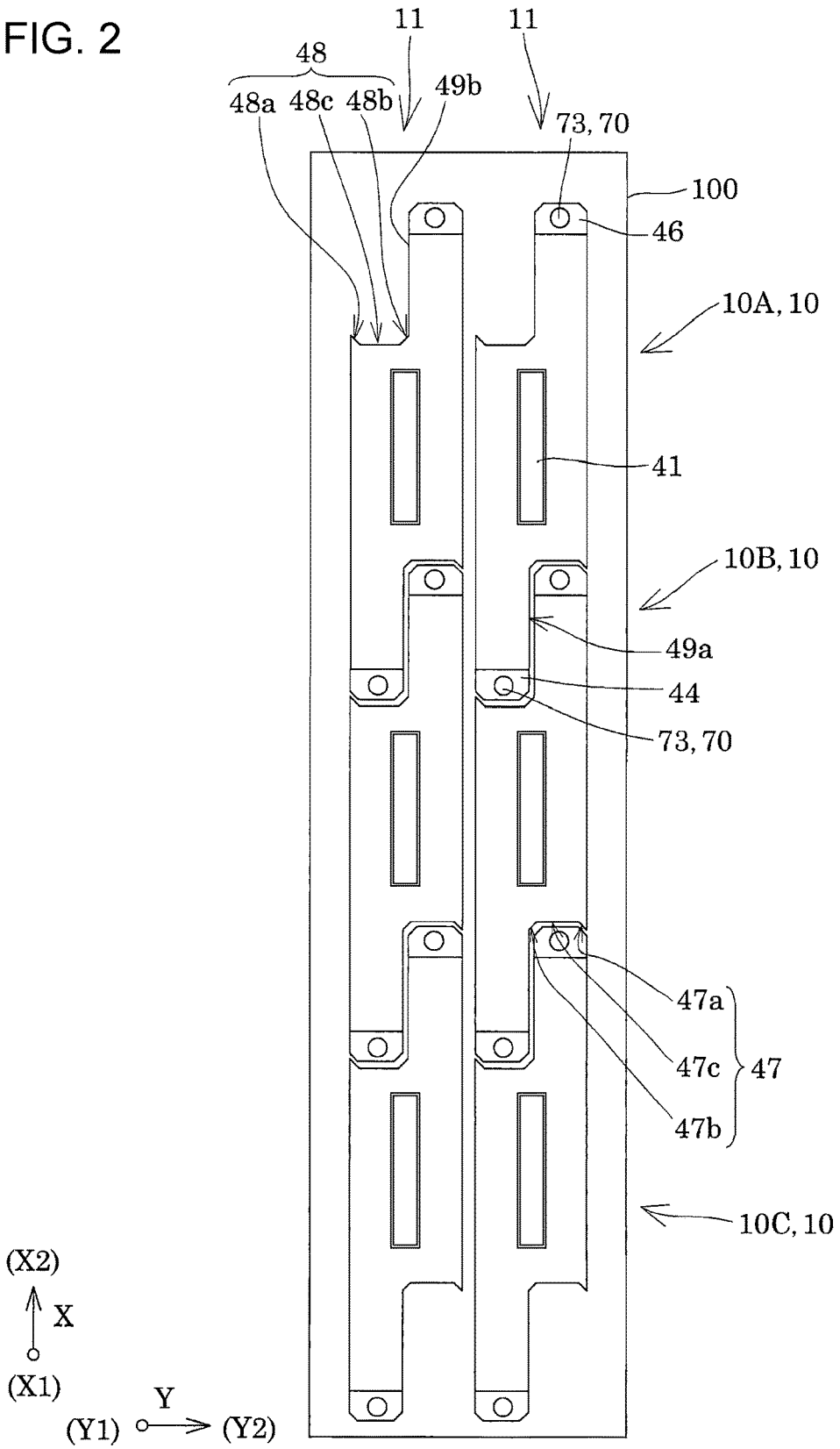
FIG. 2 is a top view of the head unit according to Embodiment 1 of the invention.

FIG. 1 is a perspective view of an ink jet recording head unit which is a liquid ejecting head unit according to Embodiment 1 of the invention. FIG. 2 is a top view of the ink jet recording head unit.

As shown in the drawing, an ink jet recording head unit 1 (hereinafter referred to as head unit 1), which is an example of a liquid ejecting head unit of the embodiment, includes a plurality of ink jet recording heads 10 (hereinafter referred to as recording head 10), and a support body 100 which commonly supports a plurality of recording heads 10.

The support body 100 is a plate-like member that supports a plurality of recording heads 10. The plurality of recording heads 10 configure a head group 11 arranged in parallel in the X direction, and are fixed to the surface on the Z1 side in the Z direction of the support body 100 in a state where the plurality of head groups 11 are arranged in the Y direction. In the embodiment, each head group 11 is configured to include three recording heads 10, and two head groups 11 are fixed to the support body 100. As a matter of course, the number of the recording heads 10 constituting the head group 11 and the number of the head groups 11 fixed to the support body 100 are not limited thereto. In the embodiment, the three recording heads 10 constituting the head group 11 are referred to as a first recording head 10A, a second recording head 10B, and a third recording head 10C from the X2 side toward the X1 side.

Opening portions 101 are formed in the support body 100 so as to correspond to each recording heads 10. The opening portion 101 is provided so as to penetrate the support body 100 in the Z direction, and specifically, is provided with an opening area into which the nozzle surface 52 side provided with a nozzle 51 to which an ink droplet of the recording head 10 described later is discharged can be inserted. In addition, the opening portion 101 is independently provided corresponding to each recording head 10. That is, two rows of three opening portions 101 arranged in parallel in the X direction corresponding to the recording head 10 are provided in the Y direction. The nozzle surfaces 52 of the plurality of recording heads 10 arranged in parallel in the X direction may be exposed from one opening portion 101.

The recording head 10 is fixed to the support body 100 in a state where the nozzle surface 52 side is inserted into the opening portion 101 of the support body 100 from the Z1 side in the Z direction. That is, the nozzle surface 52 of the recording head 10 is exposed from the support body 100 toward the Z2 side in the Z direction by the opening portion 101.

Figure 3:
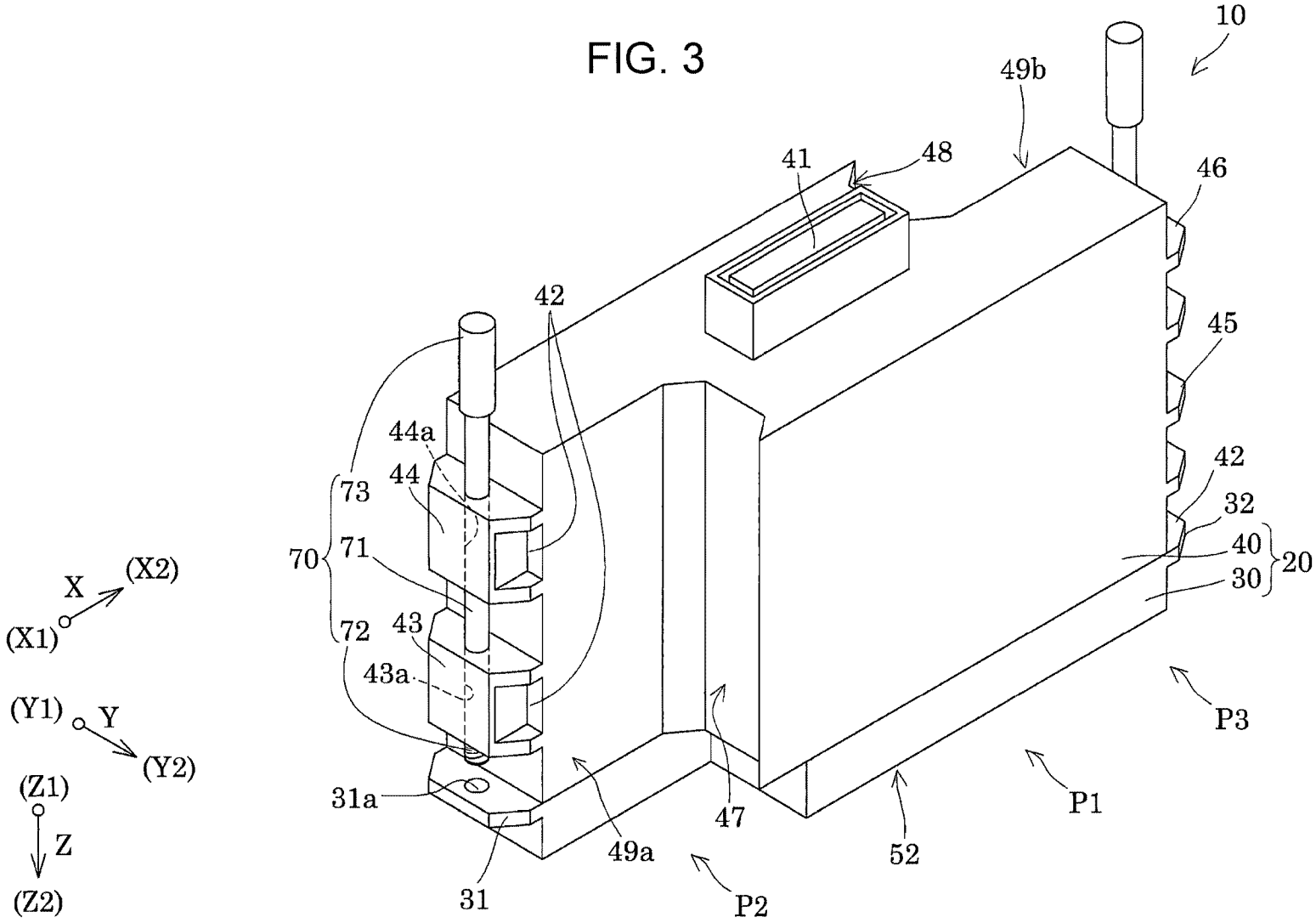
FIG. 3 is a perspective view of a recording head according to Embodiment 1 of the invention.
Figure 4:
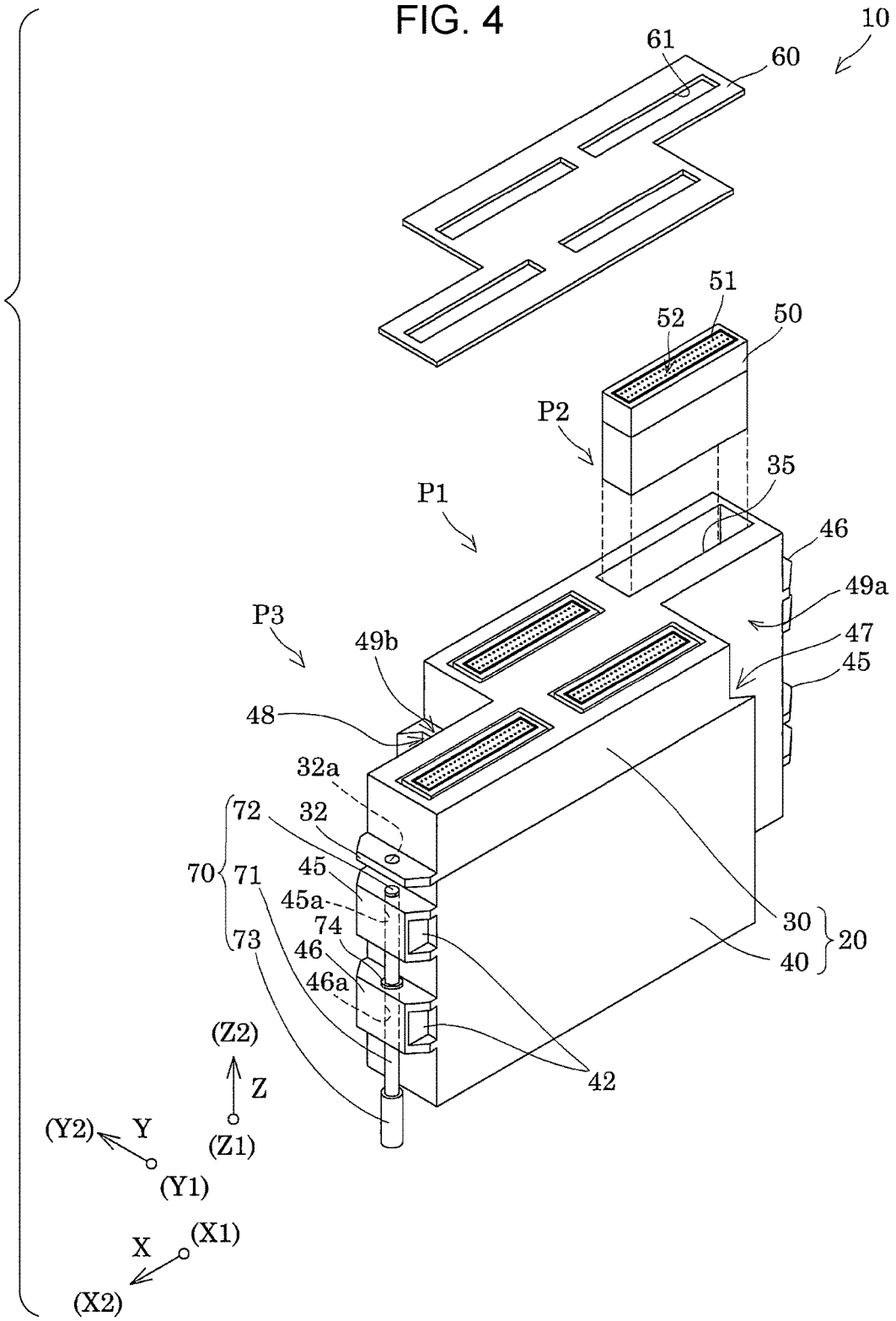
FIG. 4 is an exploded perspective view of the recording head according to Embodiment 1 of the invention.
Figure 5:
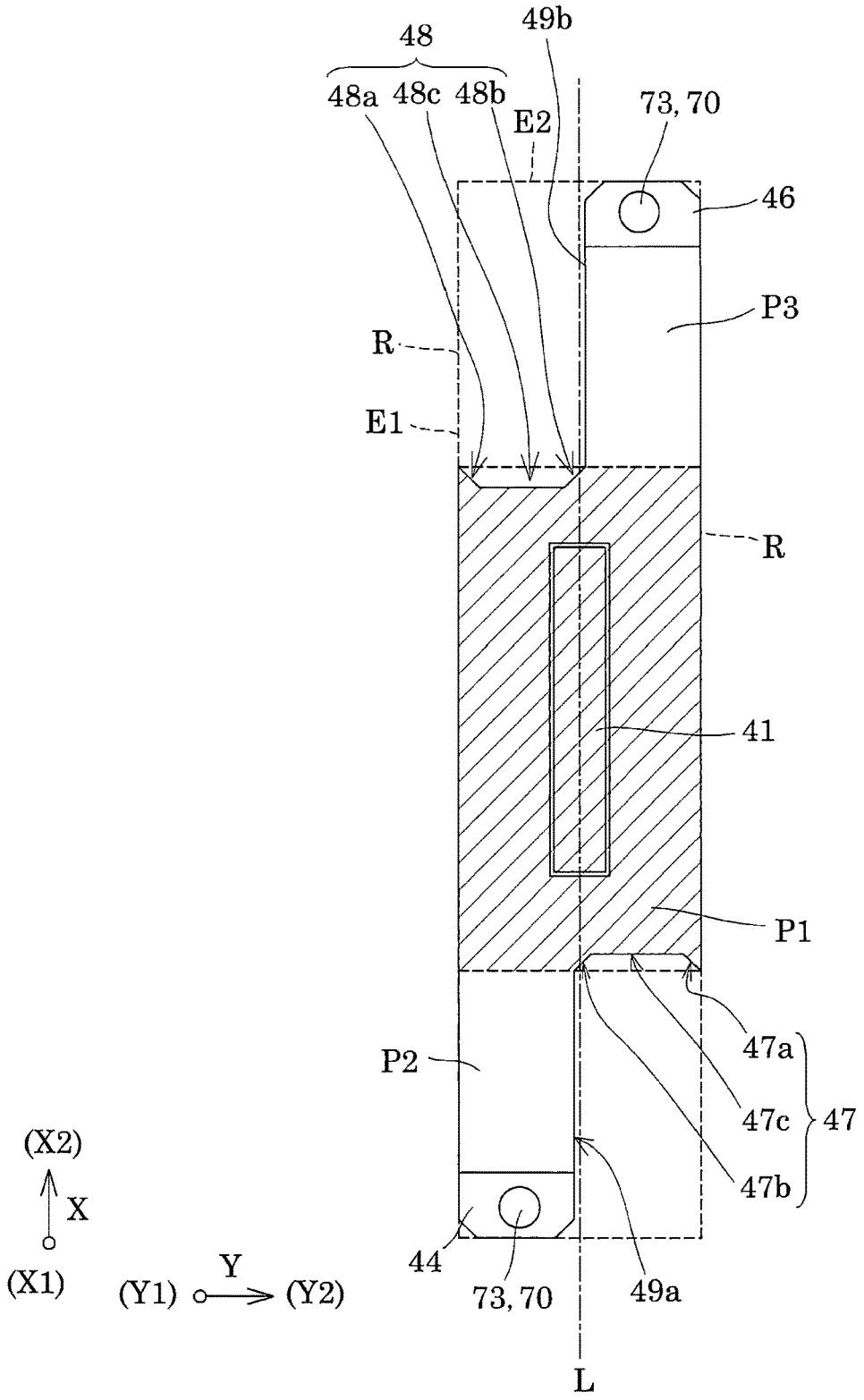
FIG. 5 is a top view of the recording head according to Embodiment 1 of the invention.
Figure 6:
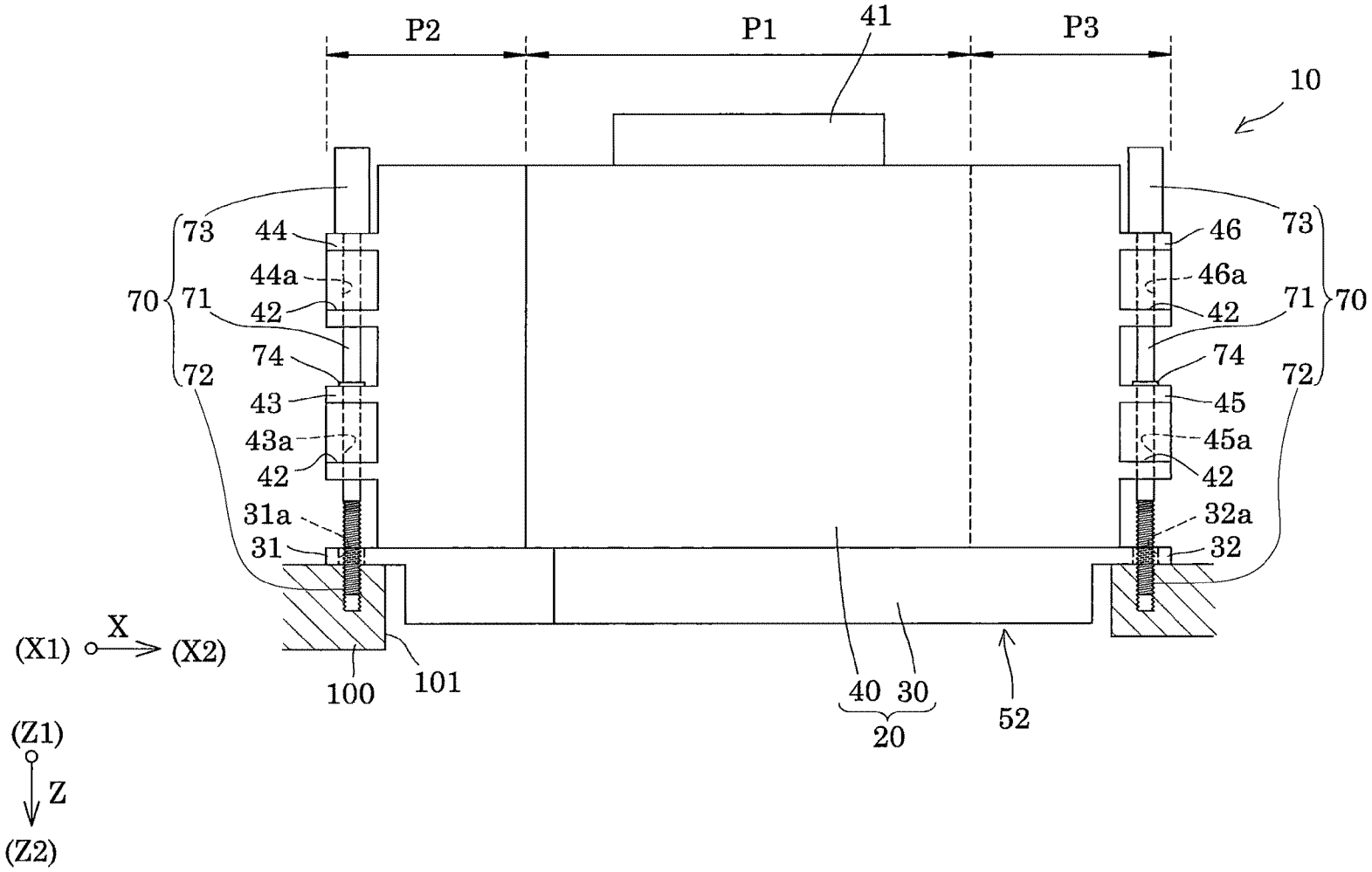
FIG. 6 is a side view of the recording head according to Embodiment 1 of the invention.
Figure 7:
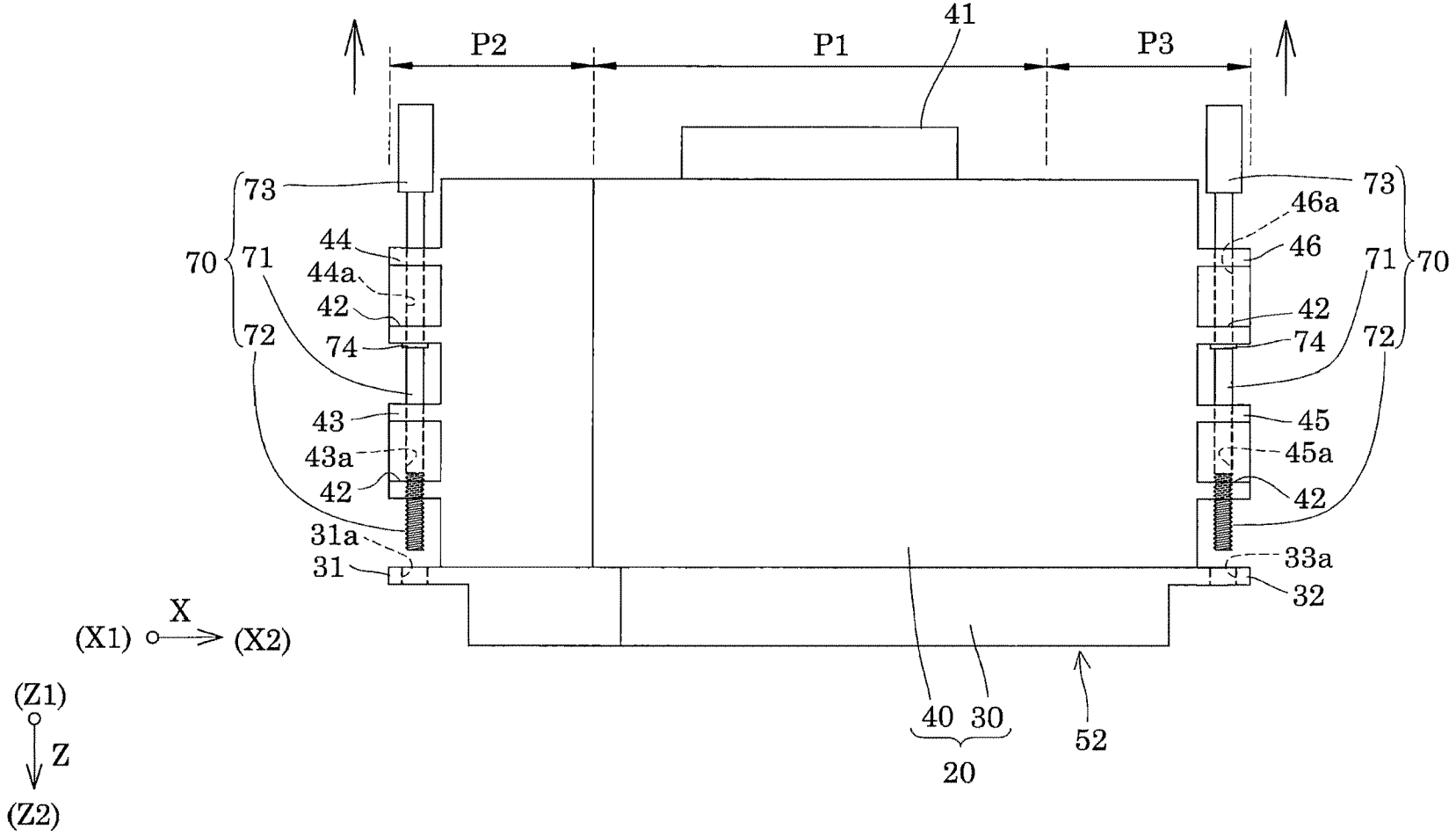
FIG. 7 is a side view of the recording head according to Embodiment 1 of the invention.

Here, the recording head 10 will be described with further reference to FIGS. 3 to 7. FIG. 3 is a perspective view of an ink jet recording head which is an example of a liquid ejecting head according to Embodiment 1 of the invention. FIG. 4 is an exploded perspective view of the ink jet recording head. FIG. 5 is a top view of the recording head. FIGS. 6 and 7 are a side view of the recording head.

As shown in the drawing, the case 20 constituting the recording head 10 includes a first case 30 and a second case 40 stacked in the Z direction. In the embodiment, the first case 30 is disposed on the Z2 side, and the second case 40 is disposed on the Z1 side in the Z direction.

In addition, the nozzle surface 52 provided with the nozzles 51 for ejecting ink is provided on the surface on the Z2 side of the case 20 in the Z direction, that is, on the surface on the Z2 side of the first case 30. That is, the first direction orthogonal to the nozzle surface 52 is the Z direction of the embodiment, and the first case 30 and the second case 40 are stacked in the Z direction which is the first direction orthogonal to the nozzle surface 52.

Here, as shown in FIG. 4, a plurality of driving portions 50 are accommodated in the first case 30. The driving section 50 is provided with the nozzle surface 52 on which the nozzle 51 for ejecting ink is formed on the Z2 side in the Z direction. In addition, a flow path communicating with the nozzle 51 and a pressure generating unit for generating a pressure change in the ink in the flow path are provided inside of the driving portion 50 (not shown). As the pressure generating unit, for example, a unit that changes the volume of the flow path by deformation of a piezoelectric actuator which has a piezoelectric material exhibiting an electromechanical conversion function to cause pressure change in the ink in the flow path to discharge ink droplets from the nozzle 51, a unit in which a heating element is disposed in the flow path and ink droplets are discharged from the nozzle 51 by bubbles generated by heat generation of the heating element, a so-called electrostatic actuator which generates an electrostatic force between the diaphragm and the electrode, deforms the diaphragm by the electrostatic force, and ejects ink droplets from the nozzle 51, and the like can be used.

The plurality of driving portions 50 are disposed in a zigzag manner along the X direction and held by the case 20. Here, disposing the plurality of driving portions 50 in the zigzag manner along the X direction means to dispose the driving portions 50 which are arranged in parallel in the X direction alternately shifted in the Y direction. That is, two rows of driving portions 50 which are arranged in parallel in the X direction are arranged in parallel in the Y direction, and the rows of the driving portions 50 of two rows are disposed by being shifted by a half pitch in the X direction. In this manner, the driving portions 50 are disposed in a zigzag manner along the X direction, so that the nozzles 51 of the two driving portions 50 can be partially overlapped in the X direction, and a row of nozzles 51 can be formed continuously over the X direction.

In accordance with such arrangement of the driving portions 50, an outer shape of the recording head 10 is determined when viewed from the Z direction, that is, when viewed from the Z direction in plan view. In the embodiment, since the outermost periphery of the recording head 10 is the outer periphery of the case 20, the outer shape of the recording head 10 coincides with the outer shape of the case 20. Specifically, as shown in FIG. 5, when the recording head 10 is viewed from the Z direction which is the first direction in plan view, a rectangle having the smallest area and including the recording head 10 is defined as R. In the embodiment, a long side E1 of the rectangle R overlaps the side along the X direction of the case 20, and a short side E2 of the rectangle R overlaps the side along the Y direction of the case 20. A center line parallel to the long side E1 of such a virtual rectangle R is defined as L.

A planar shape of the case 20 is provided with a first portion P1 (hatched portion in FIG. 5) through which the center line L passes, and a second portion P2 and a third portion P3 through which the center line L does not pass. The second portion P2 is provided on the X1 side which is one end side in the X direction of the first portion P1. The third portions P3 are arranged on the X2 side which is the side opposite to the second portion P2 with the first portion P1 interposed therebetween. That is, the second portion P2, the first portion P1, and the third portion P3 are arranged in parallel in the X direction. In the embodiment, each of the first portion P1, the second portion P2, and the third portion P3 has a shape in which a projecting portion and a recessed portion to be described later are formed with reference to a rectangular shape as a reference. That is, the recording head 10 has a shape in which a pair of diagonals is cut out in a substantially rectangular shape with reference to the rectangular shape as the reference, when viewed from the Z direction in plan view. In this manner, the second portion P2 and the third portion P3 are provided so as to project from both sides in the X direction, so that when the driving portions 50 are arranged in the zigzag manner in the X direction, the driving portions 50 can be arranged in the second portion P2 and the third portion P3. Therefore, when the recording heads 10 are arranged in parallel in the X direction, it is possible to dispose the driving portion 50 of the third portion P3 of one recording head 10 and the driving portion 50 of the second portion P2 of the other recording head 10 at positions overlapping in the Y direction in the recording heads 10 adjacent to each other, and to form a row of elongated nozzles 51 continuous in the X direction by the plurality of recording heads 10.

In addition, as shown in FIG. 4, the driving portion 50 is accommodated in the first case 30 in the embodiment. That is, the fact that the case 20 accommodates the pressure generating unit includes that the case 20 accommodates the driving portion 50 provided with the pressure generating unit. In addition, in the embodiment, the driving portion 50 is accommodated in the first case 30. However, the invention is not particularly limited thereto, and the driving portion 50 may be accommodated across the first case 30 and the second case 40.

In the embodiment, the first case 30 is provided with an accommodating portion 35 having a recessed shape opening toward the Z2 side in the Z direction of the first case 30, and the plurality of driving portions 50 fixed to a fixing plate 60 are accommodated in the accommodating portion 35. In addition, an opening on the Z2 side of the accommodating portion 35 in the Z direction is sealed by the fixing plate 60. That is, the driving portions 50 are accommodated inside the space formed by the fixed plate 60 and the accommodating portion 35. The accommodating portions 35 may be provided for each of the driving portions 50 or may be provided continuously over the plurality of driving portions 50. In the embodiment, the accommodating portions 35 are provided independently for each driving portion 50.

The fixing plate 60 includes a plate-like member, and is provided with an exposure opening portion 61 that exposes the nozzle surface 52 of the driving portion 50. In the embodiment, the exposure opening portions 61 are provided independently for each driving portion 50. The fixing plate 60 is fixed to the nozzle surface 52 side of the driving portion 50 at the peripheral edge portion of the exposure opening portion 61.

In addition, as shown in FIGS. 3 and 5, at the end portion on the X1 side in the X direction, which is the second direction along the nozzle surface 52 of the first case 30, a first projecting portion 31 is provided so as to project toward the X1 side, when viewed from the Z direction in plan view. That is, the first projecting portion 31 is formed at the end portion on the X1 side of the second portion P2. Such a first projecting portion 31 is provided such that the width in the Y direction gradually decreases from the base end portion side formed with the same width as the second portion P2 in the Y direction toward the tip end projecting in the X direction, that is, toward the X1 side.

In addition, a second projecting portion 32 projecting towards the X2 side is provided at the end portion on the X2 side in the X direction of the first case 30, when viewed from the Z direction in plan view. That is, the second projecting portion 32 is formed at the end portion on the X2 side of the third portion P3. Such a second projecting portion 32 is provided such that the width in the Y direction gradually decreases from the base end portion side formed with the same width as the second portion P2 in the Y direction toward the tip end projecting in the X direction, that is, toward the X2 side.

The first projecting portion 31 and the second projecting portion 32 are provided on the Z1 side which is the side opposite to the nozzle surface 52 of the first case 30 in the Z direction. When the recording head 10 is inserted into the opening portion 101 of the support body 100, the first projecting portion 31 and the second projecting portion 32 are provided so as to project until reaching the outside of the opening portion 101, that is, to the position relatively facing the surface on the Z1 side of the support body 100 at the opening edge portion of the opening portion 101. Therefore, when the recording head 10 is inserted into the opening portion 101 of the support body 100, the first projecting portion 31 and the second projecting portion 32 abut on the surface on the Z1 side of the support body 100, so that the insertion of the recording head 10 into the opening portion 101 is restricted. In addition, as will be described in detail later, the first projecting portion 31 and the second projecting portion 32 that abut on the support body 100 are fixed to the support body 100, so that the recording head 10 is fixed to the surface on the Z1 side of the support body 100.

In addition, a wiring electrically connected to the pressure generating unit, a flow path for supplying the ink to the driving portion 50, and the like are formed in the inside not shown of the second case 40. In addition, a filter for removing dust and air bubbles contained in the ink, a pressure adjustment unit including an on-off valve for keeping the pressure of the ink supplied to the driving portion constant, or the like may be provided inside the second case 40. In the embodiment, on the surface on the Z1 side of the second case 40, a connection portion 41 to which the external wiring is connected is provided so as to project toward the Z1 side, and the side surfaces in the X direction and the Y direction of the connection portion 41 are protected by the second case 40.

In addition, on the end portion on the X1 side of the second case 40, a third projecting portion 43 and a fourth projecting portion 44 having the same shape as the first projecting portion 31 are arranged in parallel from the Z2 side toward the Z1 side at intervals in the plan view from the Z direction. In addition, the third projecting portion 43 and the fourth projecting portion 44 are formed to be longer in the Z direction than the first projecting portion 31. Therefore, lightening portions 42 that are lightened in recessed shapes are provided on both sides of the third projecting portion 43 and the fourth projecting portion 44 in the Y direction.

In addition, on the end portion on the X2 side of the second case 40, a fifth projecting portion 45 and a sixth projecting portion 46 having the same shape as the second projecting portion 32 are arranged in parallel from the Z2 side toward the Z1 side at intervals in the plan view from the Z direction. The fifth projecting portion 45 and the sixth projecting portion 46 are formed to be longer in the Z direction than the second projecting portion 32, and the lightening portions 42 that are lightened in recessed shapes are provided on both sides in the Y direction.

That is, on the end portion on the X1 side of the case 20, the first projecting portion 31, the third projecting portion 43, and the fourth projecting portion 44 are provided so as to project toward the X1 side. On the end portion on the X2 side of the case 20, the second projecting portion 32, the fifth projecting portion 45, and the sixth projecting portion 46 are provided so as to project toward the X2 side. In the embodiment, the first projecting portion 31, the second projecting portion 32, the third projecting portion 43, the fourth projecting portion 44, the fifth projecting portion 45, and the sixth projecting portion 46 are collectively referred to as the projecting portions.

In addition, the fact that the projecting portion facing one end side in the X direction means that the projecting direction of the tip end of the projecting portion is a direction toward one end side in the X direction. That is, in the embodiment, the projecting portion facing the X1 side in the X direction refers to the first projecting portion 31, the third projecting portion 43, and the fourth projecting portion 44. The projecting portion facing the X2 side in the X direction refers to the second projecting portion 32, the fifth projecting portion 45, and the sixth projecting portion 46. Incidentally, one end side and the other end side in the X direction are arbitrarily defined, so that when the X1 side is defined as one end side, the X2 side is the other end side, and when the X2 side is defined as the one end side, the X1 side is the other end side. In the embodiment, both the projecting portion facing one end side in the X direction and the projecting portion facing the other end side are formed.

In addition, a screw 70 is accommodated in the case 20. In the embodiment, the screws 70 are accommodated in each of the projecting portion on the X1 side and the projecting portion on the X2 side of the case 20. That is, in the embodiment, one screw 70 is respectively accommodated in both end portions of the case 20 in the X direction. Here, the fact that the screw 70 is accommodated in the case 20 means that at least a portion of the screw 70 is accommodated inside the case 20. In the embodiment, one of the screw 70 is inserted into the first projecting portion 31 which is provided on the X1 side of the case 20, and a first screw insertion hole 31*a*, a third screw insertion hole 43*a*, and a fourth screw insertion hole 44*a* which are provided so as to penetrate in each of the third projecting portion 43 and the fourth projecting portion 44 in the Z direction. In addition, the screw 70 is inserted into the second projecting portion 32 which is provided on the X2 side of the case 20, and a second screw insertion hole 32*a*, a fifth screw insertion hole 45*a*, and a sixth screw insertion hole 46*a* which are provided so as to penetrate in each of the fifth projecting portion 45 and the sixth projecting portion 46 in the Z direction.

Such a screw 70 includes a shaft portion 71, a threaded portion 72 provided on the Z2 side of the shaft portion in the Z direction and screwed to the support body 100, and a knob portion 73 provided on the Z1 side in the Z direction and having an outer diameter larger than that of the shaft portion 71.

The shaft portion 71 and the threaded portion 72 of the screw 70, which are provided on the X1 side have an outer diameter smaller than that of the first screw insertion hole 31*a*, the third screw insertion hole 43*a*, and the fourth screw insertion hole 44*a*. The knob portion 73 has an outer diameter larger than that of the first screw insertion hole 31*a*, the third screw insertion hole 43*a*, and the fourth screw insertion hole 44*a*. Therefore, in the screw 70 inserted into the fourth screw insertion hole 44*a*, the third screw insertion hole 43*a*, and the first screw insertion hole 31*a* from the Z1 side in the Z direction, the knob portion 73 abuts on the fourth projecting portion 44, so that the movement on the Z2 side in the Z direction is restricted.

Similarly, the shaft portion 71 and the threaded portion 72 of the screw 70, which are provided on the X2 side have an outer diameter smaller than that of the second screw insertion hole 32*a*, the fifth screw insertion hole 45*a*, and the sixth screw insertion hole 46*a*. The knob portion 73 has an outer diameter larger than that of the second screw insertion hole 32*a*, the fifth screw insertion hole 45*a*, and the sixth screw insertion hole 46*a*. Therefore, in the screw 70 inserted into the sixth screw insertion hole 46*a*, the fifth screw insertion hole 45*a*, and the second screw insertion hole 32*a* from the Z1 side in the Z direction, the knob portion 73 abuts on the sixth projecting portion 46, so that the movement on the Z2 side in the Z direction is restricted.

In addition, the screw 70 is inserted into each insertion hole from the Z1 side in the Z direction and the threaded portion 72 is screwed to the support body 100, so that the recording head 10 is fixed to the surface on the Z1 side of the support body 100. That is, in the embodiment, one recording head 10 is fixed to the support body 100 by two screws 70 provided on both sides in the X direction.

In addition, a stopper 74 is provided on each of the outer periphery of the shaft portion 71 of the screw 70 between the third screw insertion hole 43*a* and the fourth screw insertion hole 44*a*, and the outer periphery of the shaft portion 71 of the screw 70 between the fifth screw insertion hole 45*a* and the sixth screw insertion hole 46*a*. The stopper 74 includes, for example, a retaining ring such as a C type retaining ring fixed to the outer periphery of the shaft portion 71. The stopper 74 of the screw 70 provided on the X1 side has an outer diameter larger than the inner diameter of the third screw insertion hole 43*a* and the fourth screw insertion hole 44*a*. The stopper 74 of the screw 70 provided on the X2 side has an outer diameter larger than the inner diameter of the fifth screw insertion hole 45*a* and the sixth screw insertion hole 46*a*. Therefore, as shown in FIG. 7, when the recording head 10 is lifted to the Z1 side by gripping the knob portion 73 of the two screws 70, the recording head 10 can be hung in a state where the stoppers 74 abut on each of the fourth projecting portion 44 and the sixth projecting portion 46, and the screw 70 is prevented from coming out of the recording head 10. Therefore, handling of the recording head 10, and positioning and fixing of the recording head 10 to the support body 100 can be easily performed in a state of gripping the screw 70. On the other hand, for example, when the stopper 74 is not provided on the screw 70, since the screw 70 comes off from the recording head 10, when handling or positioning the recording head 10, the case 20 or the like must be gripped. At this time, when the space for installing the recording head 10 is narrow, it is difficult to grip the case 20 and handling and positioning cannot be easily performed. That is, in the embodiment, when viewed from the Z direction in plan view, since the recording head 10 can be handled and positioned by gripping the screw 70 disposed at the position overlapping the case 20, handling and positioning of the recording head 10 can be easily performed, even in a case where a space cannot be ensured in the X direction or the Y direction of the recording head 10. Therefore, it is possible to dispose a plurality of recording heads 10 at a high density, and to reduce the size of the head unit 1 having a plurality of recording heads 10.

As shown in FIG. 6, the screw 70 is fixed to the support body 100, and the screw 70 is provided so as not to exceed the height of the case 20. That is, when the threaded portion 72 provided on the Z1 side of the screw 70 is screwed to the support body 100, the end portion of the knob portion 73 provided on the Z2 side has a length that does not project toward the Z1 side from the case 20 of the recording head 10. Incidentally, the fact that the screw 70 does not exceed the height of the case 20 includes that the end portion on the Z1 side of the screw 70 is at the same position in the Z direction as the end position on the Z1 side of the case 20. In the embodiment, since the connection portion 41 provided so as to project toward the Z1 side is provided on the Z1 side of the case 20, the same position as the connection portion 41 in the Z direction of the end portion on the Z1 side of the screw 70 is positioned on the Z2 side from the connection portion 41. As a result, when connecting the external wiring to the connection portion 41 of the case 20, and when connecting the flow path for supplying ink to the surface of the case 20 on the Z1 side, it is possible to prevent the screw 70 from being an obstacle.

In addition, as shown in FIGS. 3, 4, and 5, on the X1 side in the X direction, which is the second direction along the nozzle surface 52 of the second case 40, a first recessed portion 47 opening toward the X1 side is provided in the plan view from the Z direction. In the embodiment, the first recessed portion 47 is provided on the end surface on the X1 side of the first portion P1. In addition, the first recessed portion 47 is provided continuously over the Z direction of the second case 40. Here, the first recessed portion 47 is formed to include a first side 47*a*, a second side 47*b* facing the first side 47*a*, and a third side 47*c* connecting the first side 47*a* and the second side 47*b*, in the plan view from the Z direction. The first side 47*a* is provided so as to be inclined in a direction where the tip end is away from the second portion P2 with respect to the −X direction. In addition, the second side 47*b* is provided so as to be inclined in a direction where the tip end approaches the second portion P2 with respect to the −X direction. The second side 47*b* is provided so as to be continuous with the side surface 49*a* on the Y2 side of the second portion P2.

In addition, a second recessed portion 48 opening toward the X2 side is provided on the X2 side in the X direction of the second case 40, in the plan view from the Z direction. In the embodiment, the second recessed portion 48 is provided on the end surface on the X2 side of the first portion P1. In addition, the second recessed portion 48 is provided continuously over the Z direction of the second case 40. Here, the second recessed portion 48 is formed to include a first side 48*a*, a second side 48*b* facing the first side 48*a*, and a third side 48*c* connecting the first side 48*a* and the second side 48*b*, in the plan view from the Z direction, similar to the first recessed portion 47. The first side 48*a* is provided so as to be inclined in a direction where the tip end is away from the third portion P3 with respect to the X direction. In addition, the second side 48*b* is provided so as to be inclined in a direction where the tip end approaches the third portion P3 with respect to the X direction. The second side 48*b* is provided so as to be continuous with the side surface 49*b* on the Y1 side of the third portion P3.

That is, in the embodiment, the first recessed portion 47 opening toward the X1 side is provided on the X1 side of the second case 40, and the second recessed portion 48 opening toward the X2 side is provided on the X2 side of the second case 40. In the embodiment, the first recessed portion 47 and the second recessed portion 48 are collectively referred to as the recessed portions. In addition, the fact that the recessed portion facing the other end side in the X direction in the plan view from the Z direction means that the opening direction of the recessed portion is opposite to the projecting portion facing one end side in the X direction in the plan view from the Z direction. Therefore, the second recessed portion 48 opening toward the X2 side corresponds to the first projecting portion 31, the third projecting portion 43, and the fourth projecting portion 44 facing the X1 side of the case 20. In addition, the first recessed portion 47 opening toward the X1 side corresponds to the second projecting portion 32, the fifth projecting portion 45, and the sixth projecting portion 46 facing the X2 side of the case 20. In the embodiment, both the recessed portion facing one end side in the X direction and the recessed portion facing the other end side are formed. In addition, in the embodiment, the direction along the nozzle surface 52 is the X direction.

In addition, the recessed portion of the embodiment has the first side 47*a* and the second side 47*b*, or the first side

48*a* and the second side 48*b* facing each other, and does not include a configuration in which, for example, the first side 47*a* and the second side 48*b* are not provided. That is, each recessed portion does not include a step shape constituted only by the second side 47*b* and the third side 47*c*, or only the second side 48*b* and the third side 48*c*. In addition, the fact that the first side 47*a* and the second side 47*b* face each other, or the first side 48*a* and the second side 48*b* face each other means that the angle formed by the first side 47*a* and the second side 47*b*, or the angle formed by the first side 48*a* and the second side 48*b* is other than 90 degrees. That is, a case where two sides facing each other are provided in parallel, and a case where two sides facing each other are provided at an inclined angle other than 90 degrees are included. However, it is preferable that the opening width of the recessed portion when viewed from the Z direction in plan view be the same width as the side of the third side 47*c* and 48*c*, or wider than the side of the third side 47*c* and 48*c* on the tip end side of the bottom surface side in the X direction. As a result, the projecting portion can be easily inserted into the recessed portion from the X direction. In the embodiment, the opening shape of the first recessed portion 47 when viewed from the Z direction in plan view has substantially the same shape as the outer peripheral shape of the tip end portion projecting at least on the X2 side of the second projecting portion 32, the fifth projecting portion 45, and the sixth projecting portion 46, which are the projecting portions provided on the X2 side. That is, on the X1 side of the embodiment, the first recessed portion 47 provided toward the X1 side, and the second projecting portion 32, the fifth projecting portion 45, and the sixth projecting portion 46 which are the projecting portions provided on the X2 side have mutually exclusive shapes. Similarly, the opening shape of the second recessed portion 48 when viewed from the Z direction in plan view has substantially the same shape as the outer peripheral shape of the tip end portion projecting at least on the X1 side of the first projecting portion 31, the third projecting portion 43, and the fourth projecting portion 44, which are the projecting portions provided on the X1 side. That is, on the X2 side of the embodiment, the second recessed portion 48 provided toward the X2 side, and the first projecting portion 31, the third projecting portion 43, and the fourth projecting portion 44, which are the projecting portions provided on the X1 side have mutually exclusive shapes.

In this manner, the projecting portion facing the one end portion side in the X direction and the recessed portion facing the other end portion side are formed in mutually exclusive shapes. Therefore, as will be described in detail later, when the two recording heads 10 are arranged in parallel in the X direction, the projecting portion can be abutted on the inner surface of the recessed portion so as to engage with each other, and the movement to the approaching direction in the X direction and the movement to both sides in the Y direction of the two recording heads 10 can be restricted. It is possible to easily perform the positioning with high precision by preventing the relative positional shift between the two recording heads.

The first recessed portion 47 and the second recessed portion 48 of the second case 40 are provided so as to project on both sides in the X direction from the first case 30. That is, the side surface in the X direction of the first case 30 is disposed on the inner side from the side surface in the X direction of the second case 40. As a result, when the first projecting portion 31 and the second projecting portion 32 of the first case 30 of the other recording head 10 are abutted on the recessed portion of one recording head 10, it is possible to easily perform positioning by preventing the side surface of the first case 30 from interfering with the first projecting portion 31 and the second projecting portion 32.

The dimension in the Z direction which is the first direction of the case 20 including the first case 30 and the second case 40 as described above, that is, substantially the dimension in the Z direction of the recording head 10, is larger than the direction of the short side E2 of the rectangle R having the smallest area and including the case 20, that is, the width in the Y direction, when viewed from the Z direction in plan view.

In such a recording head 10, the projecting portion and the recessed portion provided on both sides in the X direction function as guide portions. In addition, in the embodiment, the side surface 49*a* on the Y2 side of the second portion P2 and the side surface 49*b* on the Y1 side of the third portion P3 both function as guide portions. That is, the guide portion of the embodiment includes the projecting portions and the recessed portions provided on both the X1 side and the X2 side, the side surface 49*a* on the Y2 side of the second portion P2, and the side surface 49*b* on the Y1 side of the third portion P3.

Figure 8:
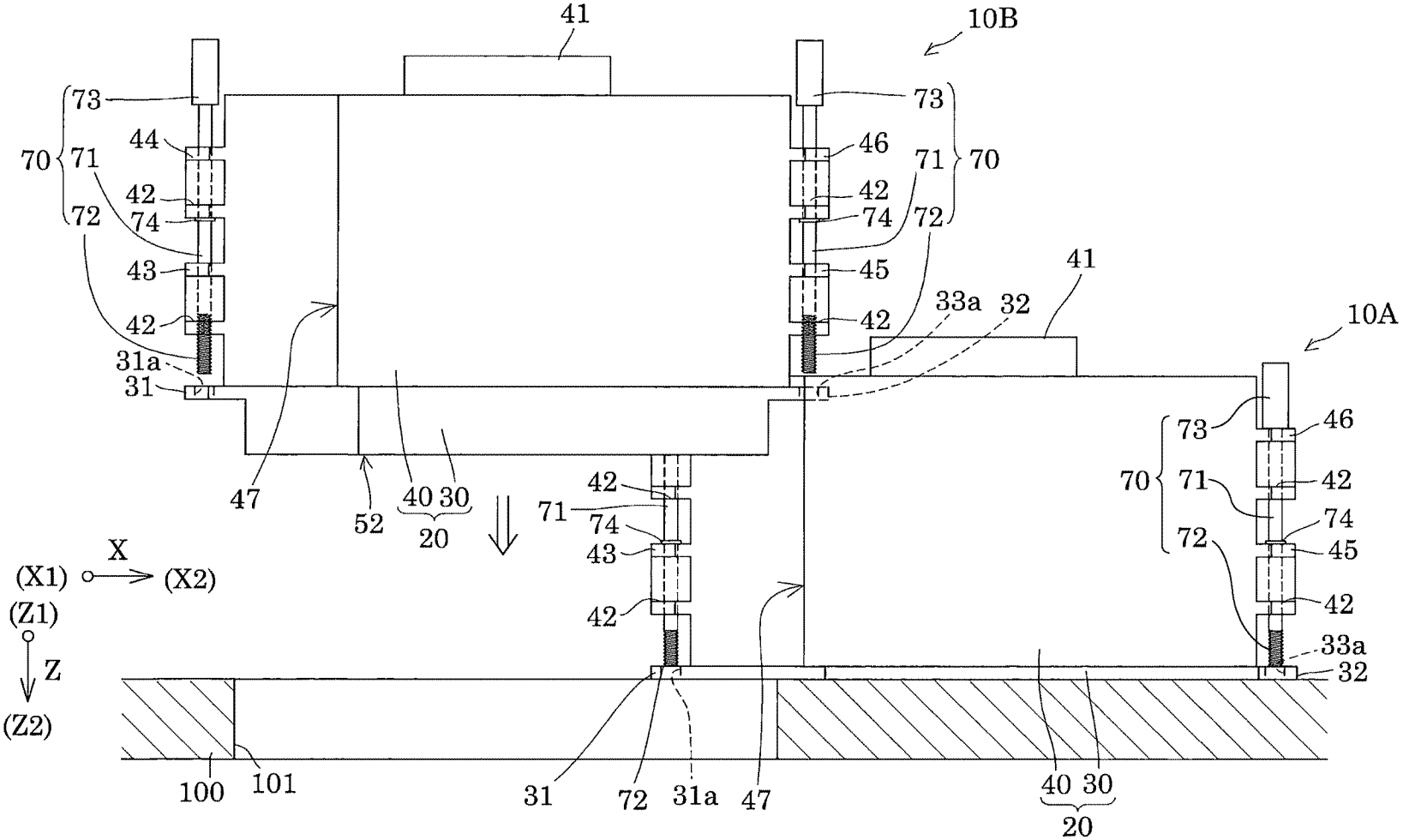
FIG. 8 is a view showing a method for manufacturing the head unit according to Embodiment 1 of the invention.
Figure 9:
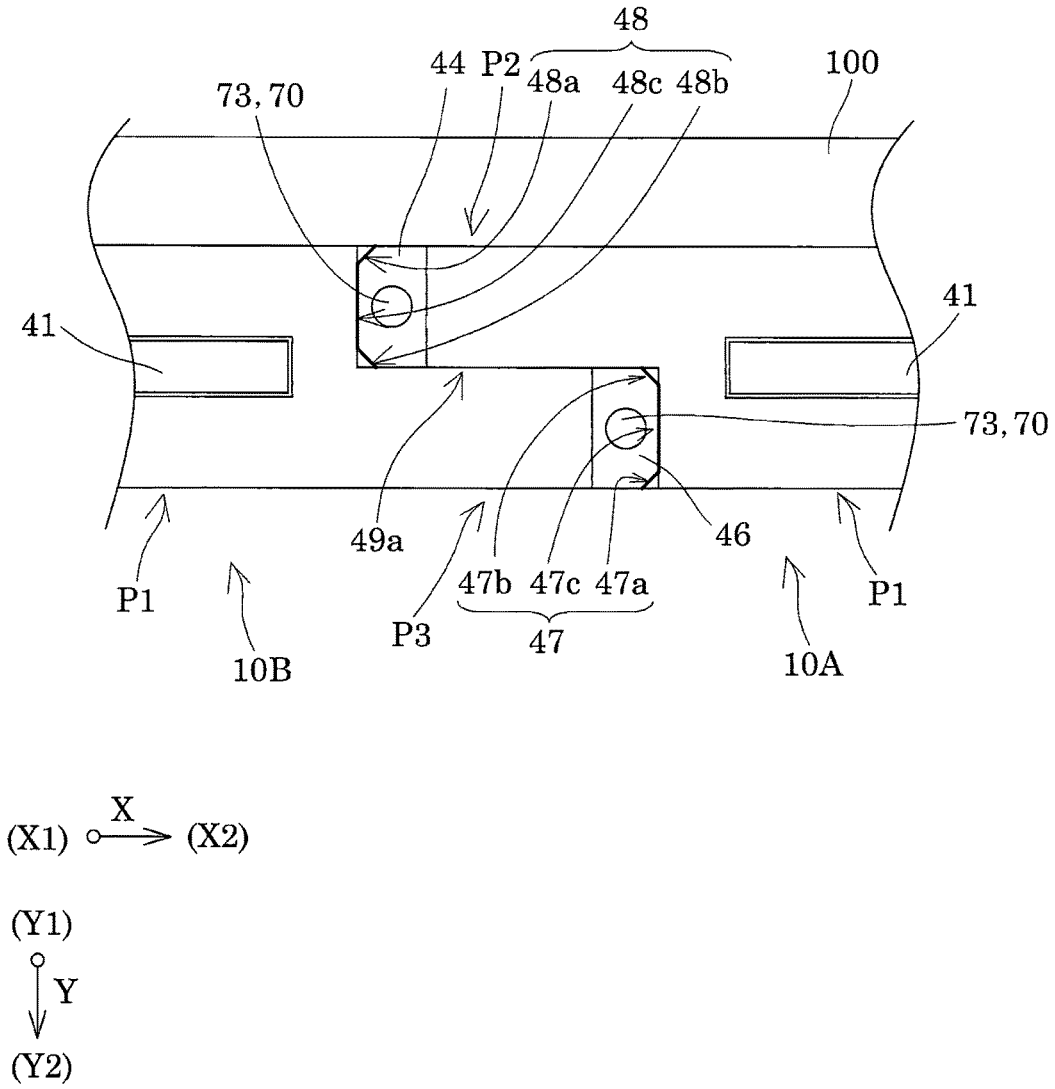
FIG. 9 is a view showing the method for manufacturing the head unit according to Embodiment 1 of the invention.
Figure 10:
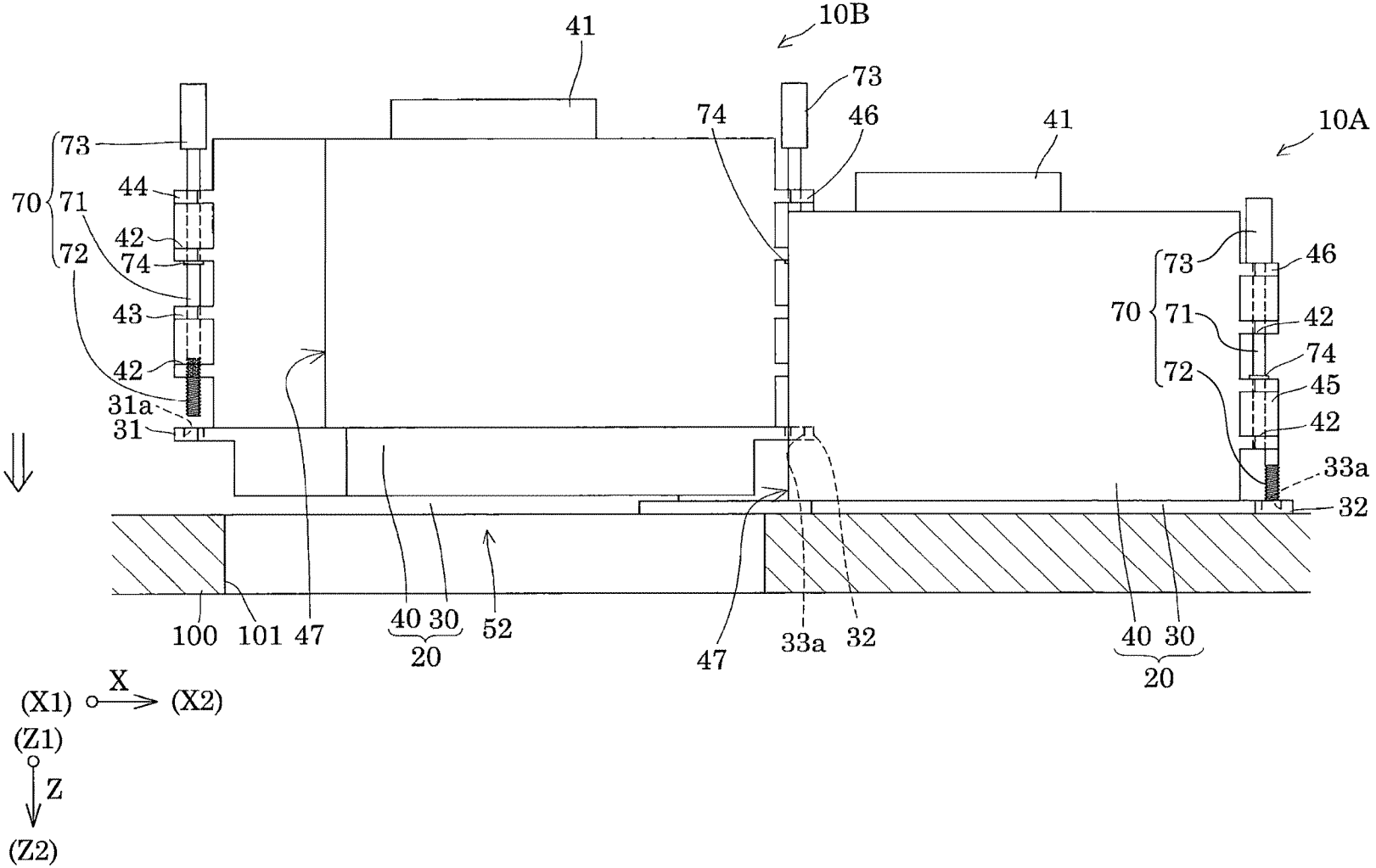
FIG. 10 is a view showing the method for manufacturing the head unit according to Embodiment 1 of the invention.
Figure 11:
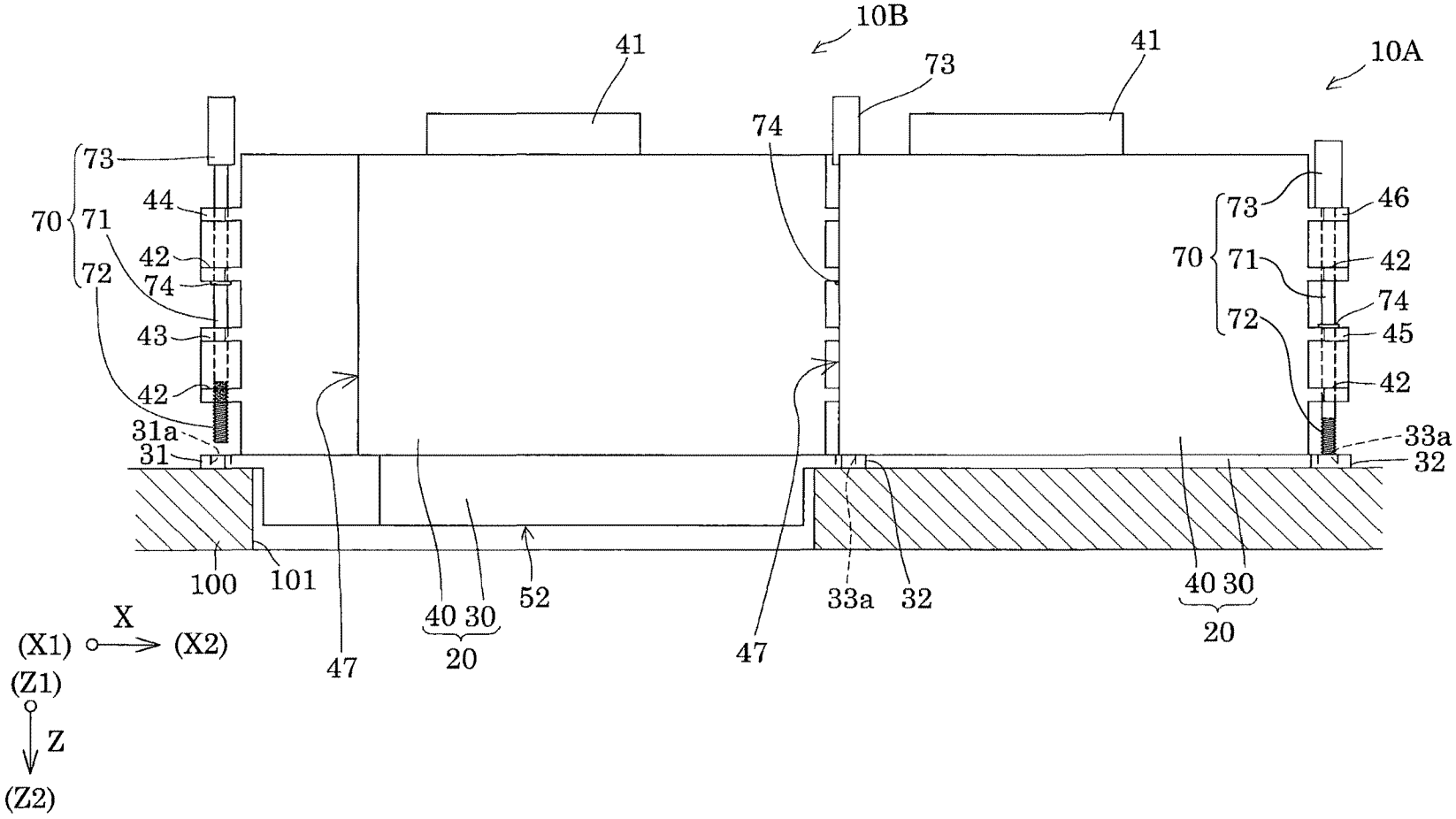
FIG. 11 is a view showing the method for manufacturing the head unit according to Embodiment 1 of the invention.

Here, when a plurality of recording heads 10 are arranged in parallel in the X direction and fixed to the support body 100, the guide portion performs a guide for positioning the relative positions of the recording heads 10 adjacent to each other. A method for manufacturing the head unit 1 of the embodiment that fixes such a recording head 10 to the support body 100 will be described with reference to FIGS. 8 to 11. FIGS. 8, 10, and 11 are side views showing the method for manufacturing the head. FIG. 9 is a top view showing the method for manufacturing the head unit. In addition, in the embodiment, three recording heads 10 fixed to the support body 100 are referred to as a first recording head 10A, a second recording head 10B, and a third recording head 10C, and members not shown in FIGS. 8 to 11 will be described with the same reference numerals.

As shown in FIGS. 8 and 9, first, the first recording head 10A is fixed to the support body 100, and thereafter the second recording head is relatively moved from the Z1 side toward the Z2 side in a state where the guide portion of the second recording head 10B which is not fixed to the support body 100 is abutted on the guide portion on the X1 side of the first recording head 10A which is fixed to the support body 100.

Specifically, the projecting portion which is the guide portion provided on the X2 side of the second recording head 10B abuts on the first recessed portion 47 which is the guide portion on the X1 side of the first recording head 10A fixed to the support body 100. In the embodiment, the second projecting portion 32 provided on the X2 side of at least the first case 30 of the second recording head 10B abuts on the inner surface of the first recessed portion 47. As a result, the movement to the X2 side and the movement to both sides in the Y direction of the second recording head 10B are restricted.

In addition, in the embodiment, only the second projecting portion 32 of the second recording head 10B abuts on the first recessed portion 47 of the first recording head 10A. That is, the second recording head 10B is moved from the Z1 side to the Z2 side with respect to the first recording head 10A on the X1 side of the first recording head 10A.

Next, as shown in FIG. 10, the second recording head 10B is moved toward the Z2 side. As a result, the second recording head 10B can be moved to the Z2 side while the fifth projecting portion 45 and the sixth projecting portion 46 provided in the second case 40 of the second recording head 10B abut on the inner surface of the first recessed portion 47. As a matter of course, the second projecting portion 32 of the second recording head 10B and either one or both of the fifth projecting portion 45 and the sixth projecting portion 46 may be simultaneously abutted on the first recessed portion 47 from the beginning. In this manner, in the embodiment, since the fifth projecting portion 45 and the sixth projecting portion 46 are provided as the projecting portions in the second case 40, by abutting the fifth projecting portion 45 and the sixth projecting portion 46 on the first recessed portion 47, it is possible to restrict the inclination of the second recording head 10B with respect to the Z direction. That is, in a case where the fifth projecting portion 45 and the sixth projecting portion 46 are not provided in the second recording head 10B, since the second projecting portion 32 and the first recessed portion 47 merely abut on each other, there is a possibility that the Z1 side of the second recording head 10B is inclined in the X direction or the Y direction around the position where the second projecting portion 32 and the first recessed portion 47 abut on each other. In the embodiment, since the fifth projecting portion 45 and the sixth projecting portion 46 which are the projecting portions are provided on the second case 40 of the second recording head 10B, it is possible to prevent the Z1 side of the second recording head 10B from being inclined in the X direction or the Y direction with respect to the Z direction.

In addition, in the embodiment, the side surface 49*a* on the Y2 side of the second portion P2 of the first recording head 10A and the side surface 49*b* on the Y1 side of the third portion P3 of the second recording head 10B abut on each other in the Y direction. As a result, the movement of the second recording head 10B toward the Y2 side with respect to the first recording head 10A is restricted, and it is possible to prevent the Z1 side of the second recording head 10B from being inclined in the Y direction. When the first recessed portion 47 of the first recording head 10A and the second projecting portion 32 of the second recording head 10B abut on each other, the second recording head 10B is moved to the X2 side while the side surface 49*b* on the Y1 side of the second recording head abuts on the side surface 49*a* on the Y2 side of the second portion P2 of the first recording head 10A. Therefore, the first recessed portion 47 of the first recording head 10A and the second projecting portion 32 of the second recording head 10B can easily be abutted on and engaged with each other. In addition, it is possible to simultaneously abut the second projecting portion 32, the fifth projecting portion 45, and the sixth projecting portion 46 on the first recessed portion 47. As a matter of course, the second recording head 10B may be disposed on the X1 side of the first recording head 10A only by moving in the Z direction without moving in the X direction.

Furthermore, in the embodiment, since the projecting portion is provided on the X1 side of the first recording head 10A and the second recessed portion 48 is provided on the X2 side of the second recording head 10B, the projecting portion of the first recording head 10A and the second recessed portion 48 of the second recording head 10B abut on each other. That is, one or both of the third projecting portion 43 and the fifth projecting portion 45 provided in the second case 40 of the first recording head 10A can abut on the first recessed portion 47 of the second recording head 10B. As a result, the movement to the X2 side and the movement to both sides in the Y direction of the second recording head 10B are restricted.

As shown in FIG. 11, the second recording head 10B is further moved to the Z2 side, so that the second recording head 10B is positioned on the support body 100. The relative positioning of the second recording head 10B with respect to the first recording head 10A by such a guide portion may be a rough positioning when mounting the second recording head 10B on the support body 100. That is, the guide portion may function as a so-called rough guide when mounting the second recording head 10B on the support body 100. After mounting the second recording head 10B on the support body 100, the guide portion may position the relative position between the nozzle 51 of the first recording head 10A and the nozzle 51 of the second recording head 10B with high accuracy by image processing or the like, and fix the second recording head 10B to the support body 100 with the screw 70.

Thereafter, although not specifically shown, similarly, the third recording head 10C (refer to FIG. 1) is fixed to the support body 100 after being positioned by the guide portion on the X1 side of the second recording head 10B, so that the head unit 1 as shown in FIG. 1 can be manufactured.

As described above, in the embodiment, the projecting portion facing one end side in the X direction and the recessed portion facing the other end side are provided as the guide portion in the case 20 of the recording head 10. Therefore, when a plurality of recording heads 10 are arranged in parallel in the X direction, the other recording head can be easily positioned with respect to one recording head by the guide portion. In addition, the guide portions of the recording heads 10 adjacent to each other in the X direction abut on each other, so that it is possible to dispose the recording heads 10 adjacent to each other in the X direction close to each other. Therefore, it is possible to reduce the size of the head unit 1, particularly in the X direction.

In addition, in the embodiment, as the guide portion provided in the case 20 of the recording head 10, both the projecting portion facing the one end side in the X direction and the recessed portion facing the other end side in the X direction, and the projecting portion facing the other end side in the X direction and the recessed portion facing the one end side in the X direction are provided. Therefore, two projecting portions and two recessed portions can be abutted on each other in the recording heads 10 adjacent to each other in the X direction so as to guide the positioning. Therefore, it is possible to further prevent positional shift of the recording heads 10 adjacent to each other in the X direction. In addition, in the embodiment, both the projecting portion and the recessed portion are provided on both sides of the recording head 10 in the X direction, so that the outer shape of the recording head 10 can be point symmetrical. Therefore, since the recording head 10 can be disposed to rotate by 180 degrees, it is possible to easily manufacture the head unit 1 having a plurality of recording heads 10.

In particular, the dimension in the X direction of the case 20 substantially defining the outer shape of the recording head 10 of the embodiment is larger than the width in the Y direction which is the direction of the short side E2 of the rectangle R having the smallest area and including the case 20 when the case 20 is viewed from the X direction in plan view. In this manner, since the recording head 10 has a small installation area and a high height in the Z direction, by providing the guide portion, it is possible to easily position and dispose a plurality of recording heads in the X direction.

In addition, in the embodiment, in the plan view from the Z direction, the width in the Y direction of the first recessed portion 47 and the second recessed portion 48 gradually decreases from the opening toward the third side 47*c* and 48*c* which is the bottom surface in the X direction, and the projecting portion is provided such that the width gradually decreases toward the tip end in the X direction. Therefore, the plurality of recording heads 10 are relatively moved in the X direction, so that the recessed portion and the projecting portion can be easily engaged with each other.

In addition, in the embodiment, the case 20 of the recording head 10 includes the first case 30 and the second case 40 stacked in the Z direction. The first projecting portion 31 and the second projecting portion 32 which are the projecting portions are provided in the first case 30, and the first recessed portion 47 and the second recessed portion 48 which are the recessed portions are provided in the second case 40. Therefore, when a plurality of recording heads 10 are arranged in parallel in the X direction, since the recessed portion of the second case 40 on the Z1 side of one recording head 10 and the projecting portion of the first case 30 on the Z2 side of the other recording head 10 engage with each other, it is possible to move the other recording head 10 from the Z1 side to the Z2 side in a state where the other recording head 10 is positioned on the Z1 side of the one recording head 10.

In the embodiment, although the projecting portion is provided on the first case 30 and the recessed portion is provided on the second case 40, it is not limited thereto, and the recessed portion may be provided in the first case 30 and the projecting portion may be provided in the second case 40.

In addition, when viewed from the Z direction in plan view, the case 20 of the embodiment has a shape in which the first portion P1 through which the center line L parallel to the long side E1 of the rectangle R having the smallest area and including the case 20 passes, and the second portion P2 not passing through the center line L are arranged in the X direction which is the direction of the long side, and has a shape in which the third portion P3 not passing through the center line L is disposed on the side opposite to the second portion P2 with the first portion P1 interposed therebetween. Therefore, when a plurality of recording heads 10 are arranged in parallel in the X direction, the size in the Y direction can be reduced. In addition, when positioning the recording heads 10 adjacent to each other in the X direction, the side surfaces 49*a* and 49*b* in the Y direction of the second portion P2 and the third portion P3 of the recording heads 10 adjacent to each other can be abutted on each other and guided. Therefore, it is possible to prevent the positional shift in the Y direction of the recording heads 10 adjacent to each other in the X direction.

In addition, in the embodiment, the screw 70 that fixes the recording head 10 to the support body 100 is accommodated in the case 20. In this manner, by accommodating the screw 70 in the case 20, it is possible to fix the recording head 10 to the support body 100 by the screw 70 from the side of the case 20, that is, from the Z1 side. Therefore, the process can be simplified compared with the case where the recording head 10 is screwed from the nozzle surface 52 side. In addition, it is unnecessary to provide the screw 70 in a new space, and the size of the recording head 10 can be reduced in the X direction and the Y direction so that the plurality of recording heads 10 can be disposed as close as possible to each other.

In addition, in the embodiment, the screws 70 are provided on the projecting portion of the case 20, that is, at both end portions in the X direction. In the recording head 10 of the embodiment, when viewed from the Z direction in plan view, since the long side E1 of the rectangle having the smallest area and including the recording head 10 overlaps the side along the X direction, the recording head 10 is fixed to the support body 100 by the screw 70 at both end portions in the long side direction. Therefore, it is possible to prevent the positional shift of the recording head 10 with respect to the support body 100.

In addition, in the embodiment, on the outer periphery of the screw 70, the stopper 74 is provided so as to restrict the screw 70 from coming out of the case 20. Therefore, by gripping the screw 70, the recording head 10 is hung without gripping the case 20, and handling of the recording head 10 and positioning of the recording head 10 with respect to other recording heads 10 can be easily performed. In addition, since the recording head 10 can be handled while gripping the screw 70, it is possible to dispose the recording heads 10 close to each other without leaving a space for gripping the plurality of recording heads 10, and to reduce the size of the head unit 1.

In addition, in the embodiment, in a state where the screw 70 is fixed to the support body 100, the screw 70 is provided so as not to exceed the height of the case 20. As a result, it is possible to prevent the screw 70 from being an obstacle when connecting the external wiring and the flow path to the recording head 10.

In the embodiment, although the first projecting portion 31, the third projecting portion 43, and the fourth projecting portion 44 projecting toward the X1 side are provided at the end portion on the X1 side of the case 20, and the second projecting portion 32, the fifth projecting portion 45, and the sixth projecting portion 46 projecting toward the X2 side are provided at the end portion on the X2 side of the case 20, it is not particularly limited thereto. For example, only one of the first projecting portion 31, the third projecting portion 43, and the fourth projecting portion 44 on the X1 side, and the second projecting portion 32, the fifth projecting portion 45, and the sixth projecting portion 46 on the X2 side of the case 20 may be provided. For example, in a case where only the first projecting portion 31, the third projecting portion 43, and the fourth projecting portion 44 on the X1 side are provided, only the second recessed portion 48 opening toward the X2 side may be provided. In addition, for example, in a case where only the second projecting portion 32, the fifth projecting portion 45, and the sixth projecting portion 46 on the X2 side are provided, only the first recessed portion 47 opening toward the X1 side may be provided. That is, if the projecting portion facing one end side in the X direction and the recessed portion facing the other end side in the X direction are provided, when the plurality of recording heads 10 are arranged in parallel in the X direction, the other of the projecting portion and the recessed portion of the other recording head 10 can be guided in one of the projecting portion and the recessed portion of one recording head 10. Therefore, it is possible to easily position the plurality of recording heads. However, as in Embodiment 1 described above, both of the projecting portion and the recessed portion are provided on both the X1 side and the X2 side. Therefore, the positional shift in the Y direction is unlikely to occur when guiding the recording head 10, and the positional shift in the rotational direction with reference to an abutting position in a state where the projecting portion and the recessed portion abut on each other is unlikely to occur. Therefore, the guide can be further easily performed and the positioning can be easily performed.

Embodiment 2

Figure 12:
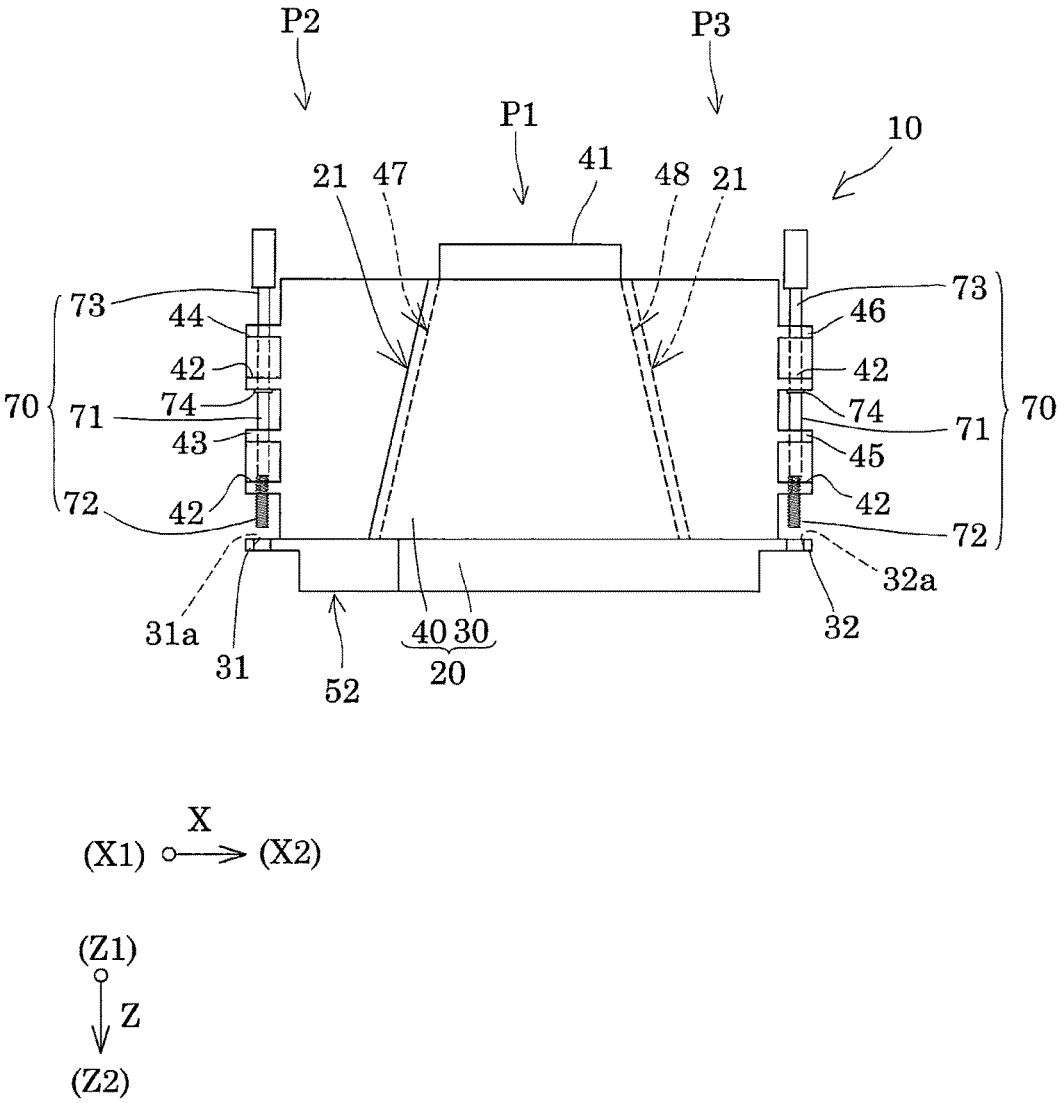
FIG. 12 is a side view of a recording head according to Embodiment 2 of the invention.
Figure 13:
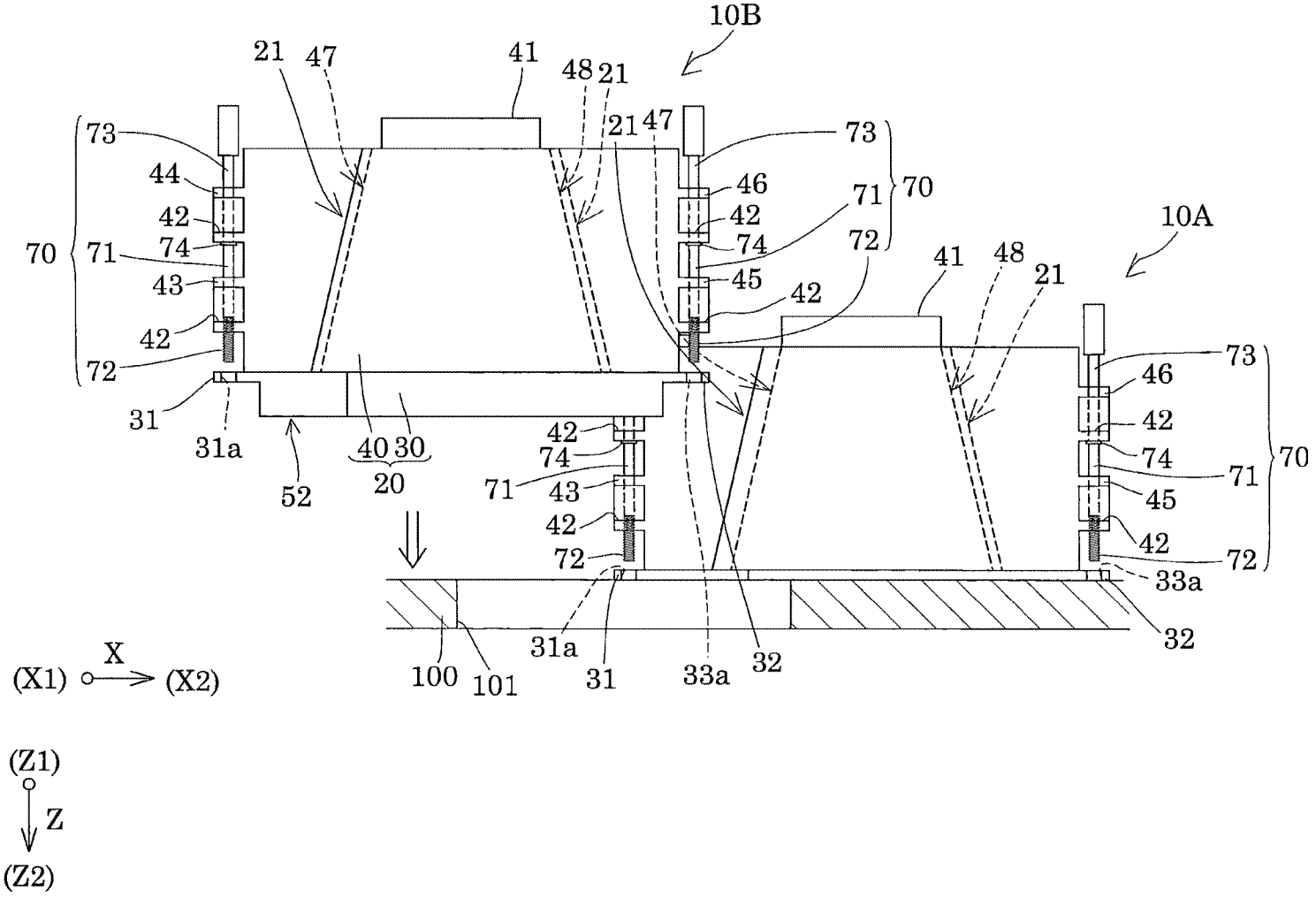
FIG. 13 is a view showing a method for manufacturing a head unit according to Embodiment 2 of the invention.

FIG. 12 is a side view of an ink jet recording head which is an example of a liquid ejecting head according to Embodiment 2 of the invention. FIG. 13 is a side view showing a method for manufacturing a head unit. The same reference numerals are given to members similar to those in the embodiment described above, and redundant descriptions will not be repeated.

As shown in FIG. 12, a case 20 includes a first case 30 and a second case 40, and at both end portions in the X direction of a first portion P1 of the second case 40, a tapered portion 21 in which the width in the X direction gradually reduces from the Z2 side which is the nozzle surface 52 in the Z direction toward the Z1 side which is the opposite side is provided.

A recessed portion of a guide portion is provided in the tapered portion 21. That is, a first recessed portion 47 and a second recessed portion 48 are provided continuously in the Z direction of the tapered portion 21.

In such a recording head 10, as shown in FIG. 13, when positioning a second recording head 10B not fixed to a support body 100 to the X1 side of a first recording head 10A fixed to the support body 100, since the Z1 side is widely opened by the tapered portion 21 on the X1 side where the first recessed portion 47 of the first recording head 10A is provided, the second recording head 10B is likely to be inserted from the Z1 side to the X2 side of the first recording head 10A. In particular, in a case of exchanging only the second recording head 10B, that is, even in a case where a sufficient space cannot be ensured on the X1 side of the first recording head 10A, such as a case where the first recording head 10A and a third recording head 10C are fixed to the support body 100 and the second recording head 10B is inserted between the first recording head 10A and the third recording head 10C, a case where other members are disposed on both sides in the X direction of the head unit 1, in the embodiment, since the space on the Z1 side of the first recording head 10A is expanded in the X direction by providing the tapered portion 21, the second recording head 10B can be likely to be inserted.

In the embodiment, although the tapered portion 21 is provided on both side surfaces in the X direction of the first portion P1, it is not limited thereto. The tapered portions may be provided on the X1 side of the second portion P2 and the X2 side of the third portion P3, and a projecting portion may be provided on the tapered portions. That is, the tapered portion may be anyone that gradually decreases the width of the case in the X direction from the Z2 side to the Z1 side, and any one of the projecting portion and the recessed portion may be formed in the tapered portion.

Another Embodiments

Hereinbefore, although Embodiment 1 of the invention has been described, the invention is not limited to the above-described embodiments.

Figure 14:
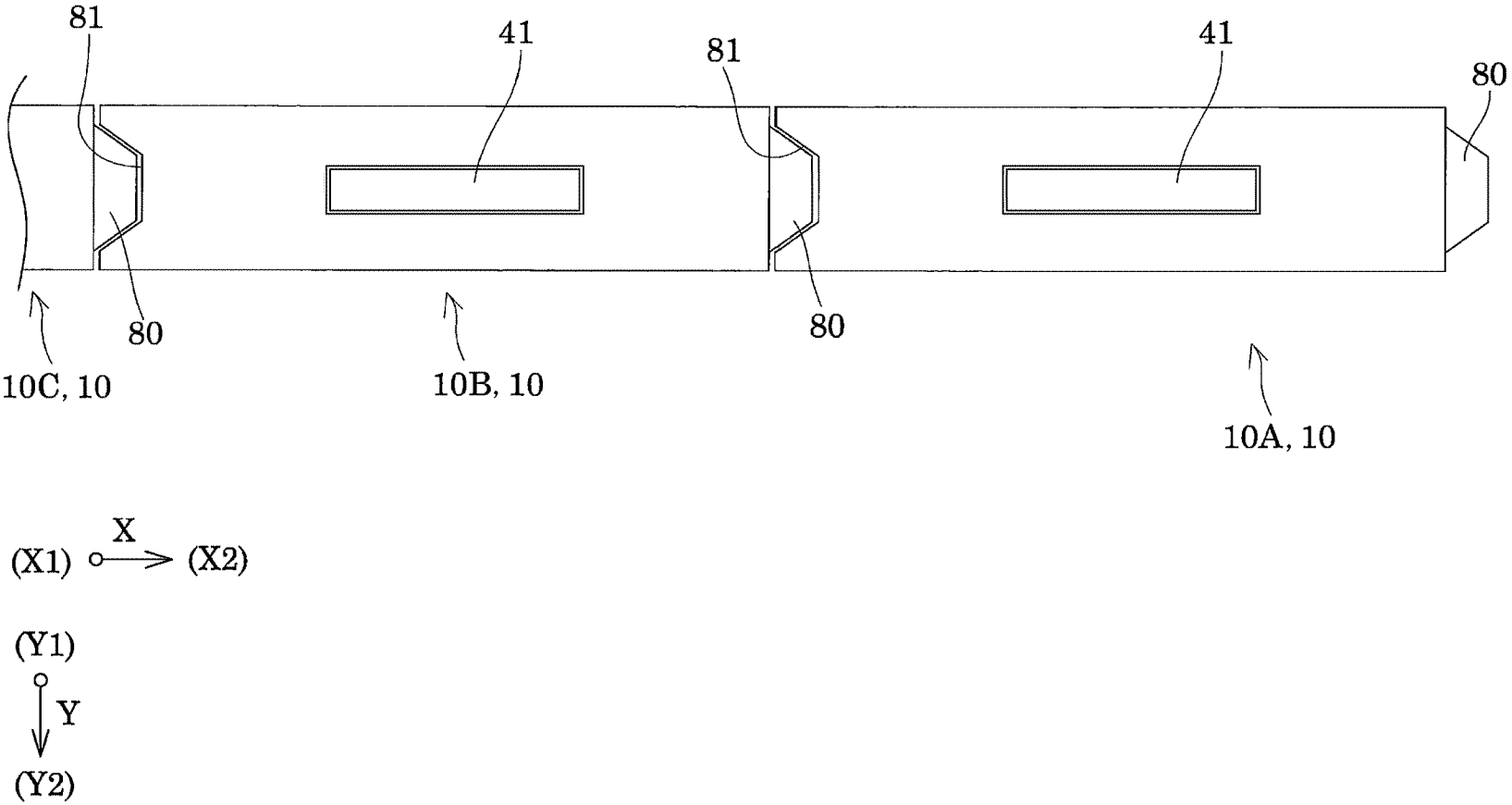
FIG. 14 is a top view showing a modified example of a recording head according to another embodiment of the invention.
Figure 15:
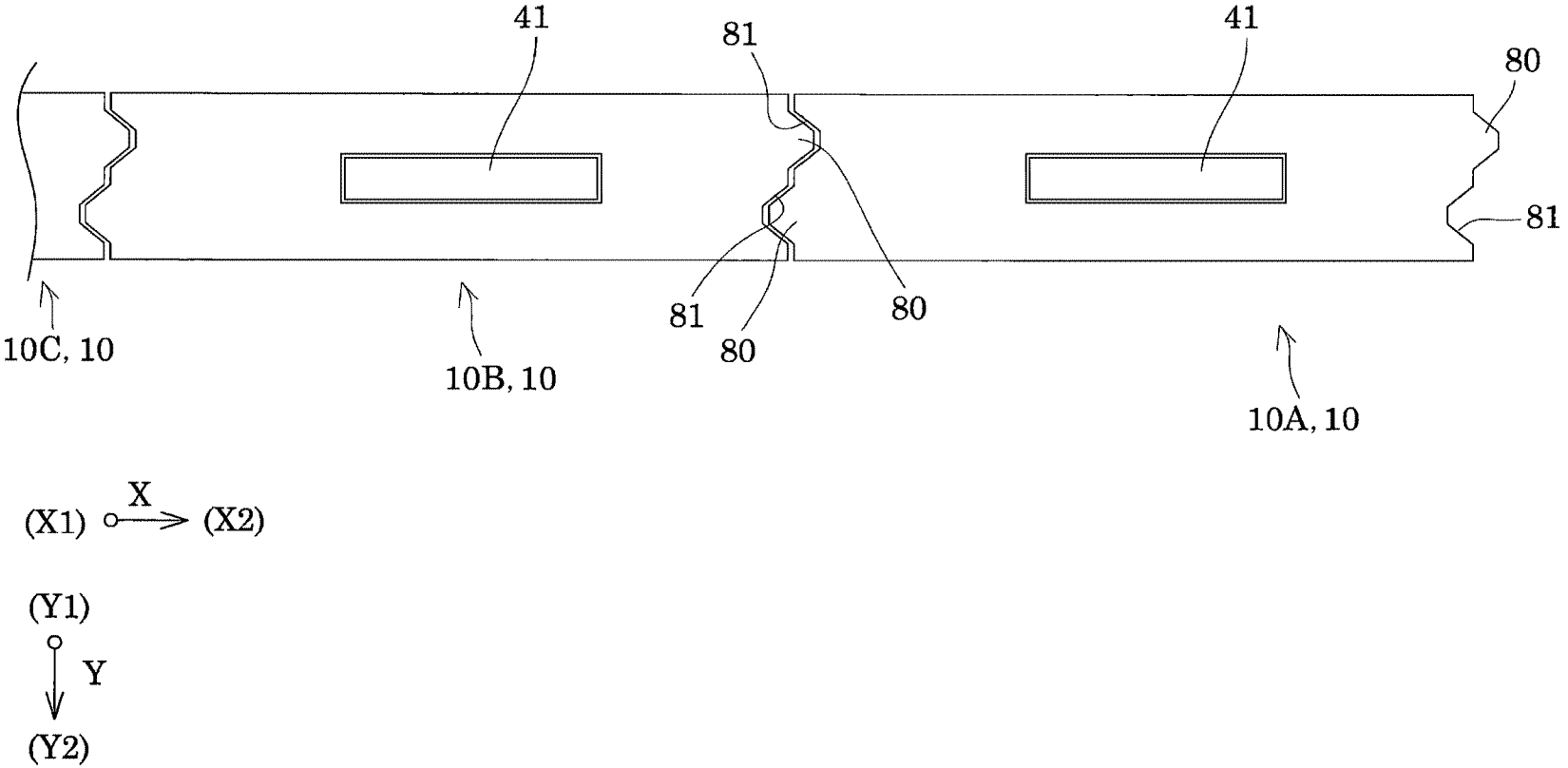
FIG. 15 is a top view showing a modified example of a recording head according to another embodiment of the invention.

For example, in each of the embodiments described above, in the plan view from the Z direction, although the recording head 10 is provided with the first portion P1, the second portion P2, and the third portion P3, it is not limited thereto. For example, in the plan view from the Z direction, the recording head 10 may have a rectangular shape. Such an example is shown in FIG. 14. As shown in FIG. 14, in the plan view from the Z direction, the recording head 10 has the rectangular shape. In addition, a projecting portion 80 that projects toward the X2 side is provided at the end portion on the X2 side of the recording head 10. The projecting portion 80 can use at least one selected from the second projecting portion 32, the fifth projecting portion 45, and the sixth projecting portion 46. In addition, a recessed portion 81 opening toward the X1 side is provided at the end portion on the X1 side of the recording head. For example, the same recessed portion 81 as the first recessed portion 47 can be used. In such a recording head 10, for example, the projecting portion 80 provided on the X2 side of the second recording head 10B is abutted on the recessed portion 81 provided on the X1 side of the first recording head 10A and moved in the Z direction. Therefore, it is possible to position and fix the second recording head 10B on the support body 100 by guiding the second recording head 10B with respect to the first recording head 10A. In addition, as shown in FIG. 15, the projecting portion 80 and the recessed portion 81 may be provided on the X1 side of the rectangular recording head 10 in the plan view from the Z direction, and the projecting portion 80 and the recessed portion 81 may be provided on the X2 side. In this manner, the projecting portions 80 and the recessed portions 81 are provided on both the X1 side and the X2 side. Therefore, since the recording head 10 can be rotated by 180 degrees and disposed, it is possible to easily manufacture the head unit 1 having the plurality of recording heads 10.

In addition, in each of the embodiments described above, although the projecting portions such as the third projecting portion 43, the fourth projecting portion 44, the fifth projecting portion 45, and the sixth projecting portion 46 are provided on the second case 40, it is not limited thereto, and the projecting portions may not be provided on the second case 40. That is, if the recessed portion is provided in the second case 40 on the Z1 side of one of the fixed recording heads 10 and the projecting portion is formed in the first case 30 on the Z2 side of the recording head 10 which is not fixed, the projecting portion provided on the Z2 side of the recording head 10 which is not fixed can be engaged with the recessed portion on the Z1 side of the fixed recording head 10, and it is possible to guide the recording head 10 which is not fixed in the Z direction.

In addition, in each of the embodiments described above, although the projecting portion is provided in the second portion P2 and the third portion P3 and the recessed portion is provided in the first portion P1, it is not limited thereto. The projecting may be provided in the first portion P1 and the recessed portion may be provided in the second portion P2 and the third portion P3.

Figure 16:
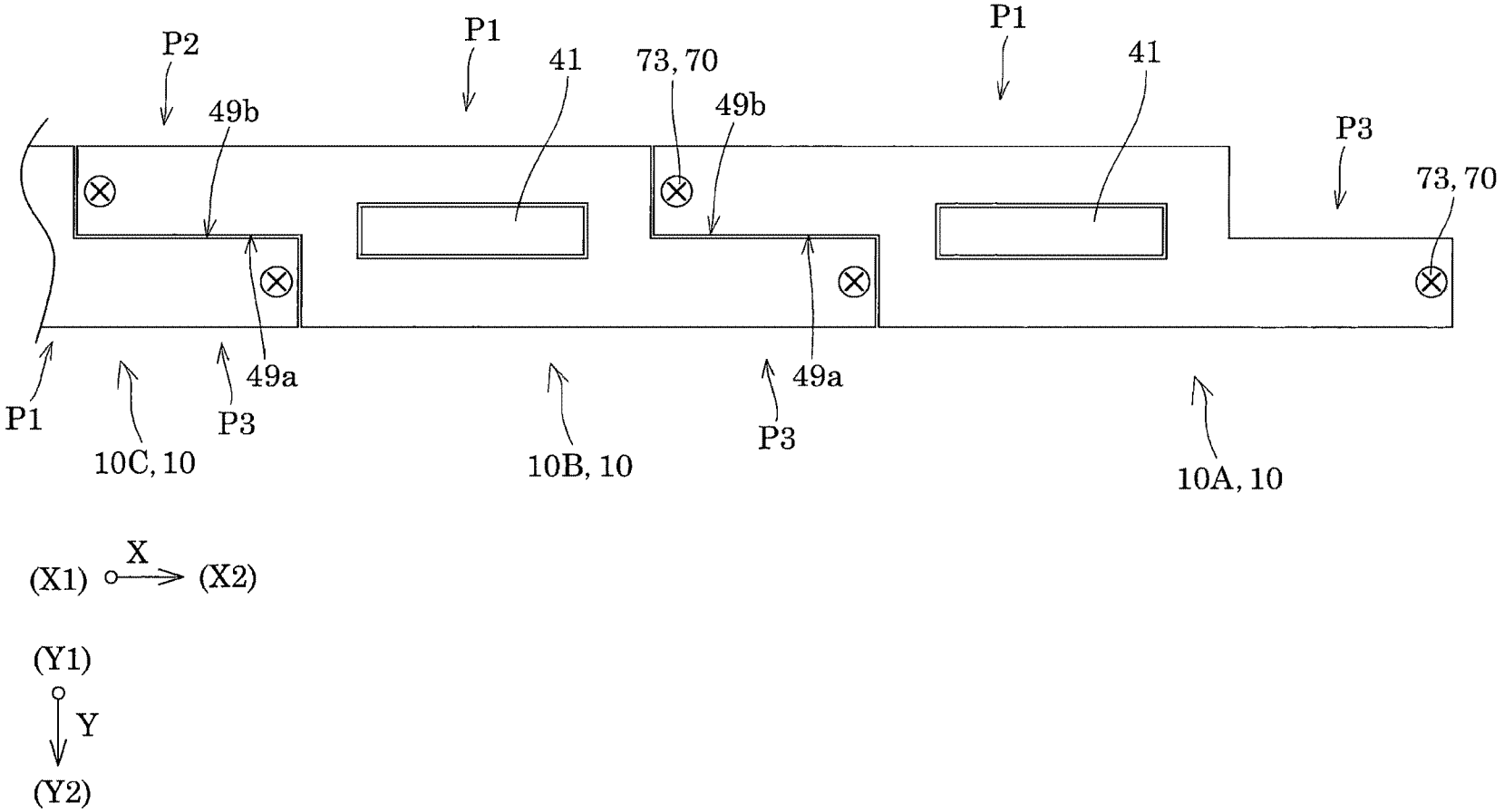
FIG. 16 is a top view showing a modified example of a recording head according to another embodiment of the invention.

In addition, in each of the embodiments described above, although the projecting portion and the recessed portion are provided as guide portions on the case 20 of the recording head 10, it is not limited thereto. The projecting portion and the recessed portion may not be provided as the guide portion in the recording head 10. Such an example is shown in FIG. 16. FIG. 16 is a top view of the recording head according to another embodiment.

As shown in FIG. 16, the recording head 10 includes the first portion P1, the second portion P2, and the third portion P3, in the plan view from the Z direction. The screws 70 are accommodated in the end portion on the X1 side of the second portion P2 and the end portion on the X2 side of the third portion P3 of the case 20 constituting the recording head 10. Such a screw 70 has the same configuration as that of Embodiment 1 described above. In such a configuration, in the plan view from the Z direction, the guide portion is configured to include a stepped shape of the outer shape formed by the first portion P1 and the second portion P2, and a stepped shape of the outer shape formed by the first portion P1 and the third portion P3. That is, the guide portion has a side surface on the X1 side of the first portion P1 and a side surface 49*a* on the Y2 side of the second portion P2 on the X1 side, and a side surface on the X2 side of the first portion P1, a side surface 49*b* on the Y1 side of the third portion P3 on the X2 side of the case 20. Therefore, for example, when positioning and fixing the second recording head 10B which is not fixed to the support body 100 on the X1 side of the first recording head 10A which is fixed to the support body 100, the side surface 49*b* on the X2 side of the first portion P1 provided on the X2 side of the second recording head 10B abuts on the side surface on the X1 side of the first portion P1 provided on the X1 side of the first recording head 10A, and the side surface 49*a* on the Y2 side of the second portion P2. Therefore, it is possible to position the second recording head 10B to move in the Z direction with respect to the first recording head 10A and fix the second recording head 10B to the support body 100.

Furthermore, in each of the embodiments described above, although the screw 70 is accommodated in the case 20 of the recording head 10, it is not limited thereto. The recording head 10 may be adhered to the support body 100 with an adhesive or the like, or the recording head 10 may be held between the support body 100 and the recording head 10 by a holding member.

In addition, the fact that the screw 70 is accommodated in the case 20 includes that the screw 70 is provided at a position overlapping the case 20 in the plan view from the Z direction which is the first direction. In this manner, in the plan view from the Z direction, by providing the screw 70 at the position overlapping the case 20, a space for providing the screw 70 is unnecessary, so that the plurality of recording heads 10 can be disposed close to each other and the size can be reduced.

Furthermore, the invention is broadly applied to liquid ejecting heads in general, and can be applied to, for example, recording heads such as various ink jet recording heads used in an image recording apparatus such as a printer, a color material ejecting head used for manufacturing a color filter such as a liquid crystal display, an electrode material ejecting head used for forming electrodes such as an organic EL display and an field emission display (FED), a bioorganic material ejecting head used for manufacturing biochips, and the like.

What is claimed is:

1. A liquid ejecting head comprising:

a pressure generating unit configured to eject liquid from a nozzle which is provided on a nozzle surface;

a case that accommodates the pressure generating unit; and a guide portion that is provided on a side surface of the case, wherein in a case of being viewed from a first direction orthogonal to the nozzle surface, the guide portion has a projecting portion facing one end side in a second direction along the nozzle surface, and a recessed portion facing the other end side in the second dire direction, wherein the case has a tapered portion of which a width of the second direction gradually reduces from the nozzle surface side in the first direction toward the opposite side, and wherein any one of the projecting portion and the recessed portion of the guide portion is provided in the tapered portion.

2. The liquid ejecting head according to claim 1, wherein the case includes a first case and a second case stacked in the first direction orthogonal to the nozzle surface, and any one of the projecting portion and the recessed portion is provided on one end side of the first case, and the other is provided on the other end side of the second case.

3. The liquid ejecting head according to claim 1, wherein the recessed portion has two opposing sides, and one side of the two sides is longer than the other side.

4. The liquid ejecting head according to claim 3, wherein the case has a tapered portion of which a width of the second direction gradually reduces from the nozzle surface side in the first direction toward the opposite side, and any one of the projecting portion and the recessed portion of the guide portion is provided in the tapered portion.

5. The liquid ejecting head according to claim 1, wherein the recessed portion is provided such that a width thereof gradually decreases from the opening toward the bottom surface in the second direction when viewed from the first direction, and the projecting portion is provided such that a width thereof gradually decreases toward the tip end in the second direction when viewed from the first direction.

6. The liquid ejecting head according to claim 1, wherein a stopper is provided on the outer periphery of the screw so as to restrict the screw so as not to come out of the case.

7. The liquid ejecting head according to claim 1, wherein in a state where the tip end of the screw is fixed, the screw does not exceed the height of the case.

8. The liquid ejecting head according to claim 1, wherein the dimension of the case in the first direction is larger than the width in the direction of the short side of a rectangle having the smallest area and including the case, when the case is viewed from the first direction.

9. A liquid ejecting head comprising:

a pressure generating unit configured to eject liquid from a nozzle which is provided on a nozzle surface; and a case that accommodates the pressure generating unit and a screw, wherein in a case of being viewed from a first direction orthogonal to the nozzle surface, the case has a shape having a first portion, a second portion, and a third portion, (i) the first portion having a first width in a third direction which is orthogonal to the first direction, (ii) the second portion having a second width which is smaller than a half of the first width, in the third direction, and (iii) the third portion having a third width which is smaller than the half of the first width in the third direction, and being arranged on the side opposite to the second portion with the first portion interposed therebetween, guide portions are provided on both sides in the direction of the long side, and the screws are provided in the second portion and the third portion.

10. The liquid ejecting head according to claim 9, wherein in a case of being viewed from the first direction, the guide portions have a projecting portion facing one end side in the direction of the long side along the nozzle surface, and a recessed portion facing the other end side in the direction of the long side.

11. The liquid ejecting head according to claim 10, wherein the recessed portion has two opposing sides, and one side of the two sides is longer than the other side.

12. A liquid ejecting head comprising:

a pressure generating unit configured to eject liquid from a nozzle which is provided on a nozzle surface; and a case that accommodates the pressure generating unit, a guide portion that is provided on a side surface of the case, wherein in a case of being viewed from a first direction orthogonal to the nozzle surface, the case has a shape having a first portion, a second portion, and a third portion, (i) the first portion having a first width in a third direction which is orthogonal to the first direction, (ii) the second portion having a second width, which is smaller than a half of the first width, in the third direction, (iii) the third portion having a third width, which is smaller than the half of the first width, in the third direction, and being arranged on the side opposite to the second portion with the first portion interposed therebetween, wherein the guide portion has (i) a first projection portion that provided at one end side in a second direction of the second portion, and is different from the second portion, and (ii) a first recessed portion that provided at the other end side in the second direction of the first portion, and is different from the first portion, the second direction being orthogonal to both of the first direction and the third direction.

13. The liquid ejecting head according to claim 12, wherein the first projection portion and the first recessed portion are formed so as to interdigitate each other.

14. The liquid ejecting head according to claim 12, wherein the first projection portion has a first side, a second side, and a third side, (i) the first side extending along the third direction, (ii) the second side extending along a direction that obliquely crosses the third direction, and (iii) the third side extending along a direction that obliquely crosses the third direction.

15. The liquid ejecting head according to claim 12, wherein the guide portion further has (iii) a second recessed portion that is provided at one end side in the second direction of the second portion, and is different from the second portion, and (iv) a second projection portion that is provided at the other end side in the second direction of the third portion, and is different from the second recessed portion.

* * * * *